US007111682B2

(12) United States Patent
Blaisdell

(10) Patent No.: US 7,111,682 B2
(45) Date of Patent: Sep. 26, 2006

(54) METHOD AND APPARATUS FOR GAS DISPLACEMENT WELL SYSTEMS

(75) Inventor: Mark Kevin Blaisdell, 1915 Laura Ct., Concord, CA (US) 94521

(73) Assignee: Mark Kevin Blaisdell, Concord, CA (US)

( * ) Notice: Subject to any disclaimer, the term of this patent is extended or adjusted under 35 U.S.C. 154(b) by 0 days.

(21) Appl. No.: 10/896,262

(22) Filed: Jul. 20, 2004

(65) Prior Publication Data

US 2005/0051329 A1 Mar. 10, 2005

Related U.S. Application Data

(60) Provisional application No. 60/489,262, filed on Jul. 21, 2003, provisional application No. 60/489,049, filed on Jul. 12, 2003.

(51) Int. Cl.
*E21B 43/12* (2006.01)

(52) U.S. Cl. ..... 166/264; 166/187; 73/152.28

(58) Field of Classification Search ..... 166/264, 166/187; 73/152.28, 863.81, 833.84
See application file for complete search history.

(56) References Cited

U.S. PATENT DOCUMENTS

| | | | |
|---|---|---|---|
| 2,511,759 | A | 6/1950 | Williams |
| 2,781,663 | A | 2/1957 | Maly et al. |
| 3,104,713 | A | 9/1963 | Lebourg |
| 3,580,332 | A | 5/1971 | Dean et al. |
| 3,823,773 | A | 7/1974 | Nutter |
| 3,876,000 | A | 4/1975 | Nutter |

(Continued)

FOREIGN PATENT DOCUMENTS

| | | |
|---|---|---|
| FR | 2 758 162 | 7/1998 |

OTHER PUBLICATIONS

Granato, G.E., Smith, K.P., "Automated Groundwater monitoring with Robowell: case studies and potential applications", Proceedings of the SPIE, Nov. 2001, Int. Soc. OPt. Eng. vol. 4575, p. 32-42, USA.

(Continued)

*Primary Examiner*—William Neuder
(74) *Attorney, Agent, or Firm*—Michael A. Glenn; Glenn Patent Group

(57) ABSTRACT

A method and apparatus is provided for reducing the purge volume of a well during purging and sampling operations. In some system embodiments, the apparatus can be retrofitted to existing small diameter wells. A further embodiment provides a method and apparatus for using direct pneumatic pressure to purge and sample small diameter wells using a removable valve. This aspect of the invention allows a direct pneumatic pressure pump with a primary valve to be withdrawn through the top of the inside to the pump's pressure holding structure without removing a riser pipe or the system's fluid inlet structure. The invention allows fitting or retrofitting small diameter wells with valves for direct pneumatic pressure purging and sampling. Other embodiments include sealing a removable valve at or above the bottom of a riser pipe, remotely attaching a tool at the top of a removable valve, withdrawing a direct pneumatic pressure pump system's primary valve through the inside of the inside pump's pressure holding structure without removing the riser pipe, and attaching a direct pneumatic pressure pump system's sample return line to its primary valve. Further embodiments include a multiple return line pneumatic pump/well, which allows the use of multiple return lines on a pneumatic pump when used to pump water from very deep wells where piezometric surface of the water is also deep, as well as other uses for direct pressure pneumatic pumping and sampling.

77 Claims, 31 Drawing Sheets

U.S. PATENT DOCUMENTS

| | | | | |
|---|---|---|---|---|
| 3,876,003 | A | | 4/1975 | Kisling, III |
| 3,964,507 | A | | 6/1976 | Jandrasi et al. |
| 4,320,800 | A | | 3/1982 | Upchurch |
| 4,339,111 | A | | 7/1982 | Welch |
| 4,354,806 | A | | 10/1982 | McMillin et al. |
| 4,409,825 | A | | 10/1983 | Martin et al. |
| 4,442,902 | A | | 4/1984 | Doremus et al. |
| 4,538,683 | A | | 9/1985 | Chulick |
| 4,573,532 | A | | 3/1986 | Blake |
| 4,635,717 | A | | 1/1987 | Jageler |
| 4,701,107 | A | | 10/1987 | Dickinson et al. |
| 4,717,473 | A | | 1/1988 | Burge et al. |
| 4,745,801 | A | | 5/1988 | Luzier |
| 4,830,111 | A | | 5/1989 | Jenkins et al. |
| 4,860,581 | A | | 8/1989 | Zimmerman et al. |
| 4,882,939 | A | | 11/1989 | Welker |
| 4,936,139 | A | | 6/1990 | Zimmerman et al. |
| 5,161,956 | A | | 11/1992 | Fiedler |
| 5,183,391 | A | | 2/1993 | Fiedler |
| 5,238,060 | A | | 8/1993 | Niehaus et al. |
| 5,259,450 | A | | 11/1993 | Fischer |
| 5,269,180 | A | | 12/1993 | Dave et al. |
| 5,270,945 | A | | 12/1993 | Heath et al. |
| 5,293,931 | A | | 3/1994 | Nichols et al. |
| 5,293,934 | A | * | 3/1994 | Burge et al. ..... 166/202 |
| 5,439,052 | A | | 8/1995 | Skinner |
| 5,450,900 | A | | 9/1995 | Schalla et al. |
| 5,452,234 | A | | 9/1995 | Heath et al. |
| 5,460,224 | A | | 10/1995 | Schalla et al. |
| 5,857,714 | A | | 1/1999 | Gustafson |
| 5,934,375 | A | | 8/1999 | Peterson |
| 6,021,664 | A | | 2/2000 | Granato et al. |
| 6,062,073 | A | | 5/2000 | Patton et al. |
| 6,192,892 | B1 | | 2/2001 | Resler |
| 6,283,209 | B1 | | 9/2001 | Keller |
| 6,302,200 | B1 | | 10/2001 | Patton et al. |
| 6,408,691 | B1 | * | 6/2002 | Sorben ..... 73/152.23 |
| 6,454,010 | B1 | | 9/2002 | Thomas et al. |
| 6,508,310 | B1 | | 1/2003 | Mioduszewski et al. |
| 6,547,004 | B1 | | 4/2003 | Last et al. |
| 6,581,455 | B1 | | 6/2003 | Berger et al. |
| 2001/0027573 | A1 | | 10/2001 | Gloodt |
| 2002/0166663 | A1 | | 11/2002 | Last et al. |
| 2003/0029230 | A1 | | 2/2003 | Murphy, Jr. et al. |
| 2003/0062472 | A1 | | 4/2003 | Mullins et al. |
| 2003/0134069 | A1 | | 7/2003 | Van Ee |
| 2003/0138556 | A1 | | 7/2003 | Binder |

OTHER PUBLICATIONS

Dean, M.R., Castro, L.F. Salerni, J.V., "Apparatus for controlling fluid flow from gas storage wells and reservoirs", 2004, Institution of Electrical Engineers (US Patent No. 3,580,332 May 25, 1971).

"Westbay Joins Schlumberger"; 2005; http://www.westbay.com/.

"Multilevel Well Systems"; 2006; http://www.slb.com/content/services/additional/water/monitoring/multilevel/index.asp.

"Westbay System—Sampling Probes"; 2006; http://www.slb.com/content/services/additional/water/monitoring/multilevel/sampling_probes.asp.

"Discrete Sampling"; 2006; http://www.slb.com/media/services/additional/water/equipment/westbay/dissampl.pdf.

Multilevel Systems; Solinst Multilevel Systems; http://www.solinst.com/Prod/Lines/MultilevelSystems.html.

Waterloo System; Model 401 Waterloo System; http://www.solinst.com/Prod/401/401MultilevelSystems.html.

CMT Multilevel System; http://www.solinst.com/Prod/403/403.html.

* cited by examiner

100j

METHOD AND APPARATUS FOR GAS DISPLACEMENT WELL SYSTEMS

CROSS-REFERENCE TO RELATED APPLICATIONS

This application claims priority from BLAI0001PR, U.S. Provisional Patent Application Ser. No. 60/489,049, filed 21 Jul. 2003 and from BLAI0002PR, U.S. Provisional Patent Application Ser. No. 60/489,262, filed 21 Jul. 2003, which are incorporated herein by reference.

FIELD OF THE INVENTION

The invention relates to the field of well systems. More particularly, the invention relates to improved well structures and processes.

BACKGROUND OF THE INVENTION

It is commonly preferred that the fluid from a well be sample or purged. Several systems and methods have been disclosed for sampling and purge systems for well environments.

M. Lebourg, Fluid Sampling Apparatus, U.S. Pat. No. 3,104,713 (24 Sep. 1963) discloses "an apparatus for obtaining a representative fluid sample of a fluid flowing in a well when taken at a given depth and at the same time giving the amount of fluid flowing at a given time".

M. Dean, L. Castro, and J. Salerni, Apparatus for Controlling Fluid Flow from Gas Storage Wells and Reservoirs, U.S. Pat. No. 3,580,332 (25 May 1971) disclose a "retrievable packer with a large surface area and control valve connected thereto are run and set in a cased well bore. A plug is set in the valve, after which a tubing is connected to the plug and fluid pressure applied thereto to open the valve so that gas from the well or reservoir can flow through the packer and opened valve into the tubing-casing annulus and into a gas delivery line at the top of the well bore. The valve is tapered to provide a greater annular area between it and the well casing to allow unrestricted flow of gas from the well at a very high rate. In the event of damage to the surface equipment, the well pressure automatically closes the control valve. The valve can be closed whenever desired and the tubing string removed, after which the plug and control valve and packer are removable from the well casing through use of wireline equipment, and without the necessity of "killing" the well."

B. Nutter, Inflatable Packer Drill Stem Testing Apparatus, U.S. Pat. No. 3,876,000 (8 Apr. 1975) discloses a "drill stem testing apparatus that utilizes inflatable packer elements to isolate an interval of the borehole includes a uniquely arranged pump that is adapted to supply fluids under pressure to the elements in response to upward and downward movements of the pipe string extending to the surface. The pump includes an inner body structure connected to the packing elements and a telescopically disposed outer housing structure connected to the pipe string, said structures defining a working volume into which well fluids are drawn during downward movement, and from which fluids under pressure are exhausted and supplied to the packing elements during upward movement, the intake passages to the pump being backflushed during each upward movement to prevent clogging by debris in the well fluids."

Drill Stem Testing Methods and Apparatus Utilizing Inflatable Packer Elements, U.S. Pat. No. 3,876,003 (8 Apr. 1975) discloses "methods and apparatus for conducting a drill stem test of an earth formation that is traversed by a borehole. More particularly, the invention concerns unique methods for performing a drill stem test through the use of spaced inflatable packer elements that function to isolate the test interval, and a pump actuated by upward and downward movement of the pipe string in a manner that enables positive surface indications of the performance of downhole equipment."

J. Upchurch, Inflatable Packer Drill Stem Testing System, U.S. Pat. No. 4,320,800 (23 Mar. 1982) discloses a "drill stem testing apparatus that utilizes upper and lower inflatable packer elements to isolate an interval of the borehole includes a unique pump system that is adapted to supply fluids under pressure to the respective elements in response to manipulation of the pipe string extending to the surface. The pump system includes a first pump assembly that is operated in response to rotation of the pipe string for inflating the lower packer element, and a functionally separate second pump assembly that is operated in response to vertical movement of the pipe string for inflating the upper packer element. The rotationally operated pump assembly is uniquely designed to limit the inflation pressure that is supplied to the lower packer, whereas the inflation pressure generated by the vertically operated pump can be monitored at the surface."

A. Jageler, Method and Apparatus for Obtaining Selected Samples of Formation Fluids, U.S. Pat. No. 4,635,717 (13 Jan. 1987) discloses a method and apparatus "operable on a wireline logging cable for sampling and testing bore hole fluids, transmitting the results obtained from such testing to the surface for determination whether or not the particular sample undergoing testing should be collected and brought to the surface. The apparatus comprises a downhole tool having an inflatable double packer for isolating an interval of the bore hole coupled with a hydraulic pump, the pump being utilized sequentially to inflate the double packer and isolate an interval of the bore hole and to remove fluids from the isolated interval to test chamber means where resistivity, redox potential (Eh) and acidity (pH) are determined, and finally to dispose of selected samples to one or more sample container chambers within said tool or to reject them into the bore hole if not selected."

K. Niehaus and D. Fischer, Sampling Pump With Packer, U.S. Pat. No. 5,238,060 (24 Aug. 1993) disclose a "fluid sampling apparatus for withdrawing samples of groundwater or other fluids from a well or other monitoring site. The apparatus preferably includes pump means, packer means, conduit means and a wellhead assembly that are permanently installed at the well or monitoring site and are thereby dedicated thereto in order to avoid or minimize cross-contamination of samples from site to site. The packer is integral with the pump and isolates the groundwater below the packer in order to minimize the amount of groundwater which must be pumped in order to purge the well prior to taking an acceptable sample. The apparatus preferably also includes a removable and portable controller means adapted for easy and convenient transportation and connection to such dedicated fluid sampling components at various wells or monitoring sites."

D. Fischer, Vented Packer for Sampling Well, U.S. Pat. No. 5,259,450 (9 Nov. 1993) discloses an apparatus "for obtaining liquid samples from a well which incorporates a vented packer. The packer reduces the amount of groundwater which must be pumped by the pump of the apparatus in order to purge the well by isolating the input of the pump to a reduced volume of groundwater. The region below the packer, which is the region in communication with the pump, is vented to the atmosphere in order to permit the pump to operate at its maximum pumping rate regardless of the recovery rate of the well. The venting of the packer eliminates the condition where the pump is trying to pull a vacuum due to a low recovery rate of the well."

R. Schalla, R. Smith, S. Hall, and J. Smart, Well Fluid Isolation and Sample Apparatus and Method; U.S. Pat. No. 5,450,900 (19 Sep. 1995) disclose an apparatus and method for "purging and/or sampling of a well but only removing, at most, about 25% of the fluid volume compared to conventional methods and, at a minimum, removing none of the fluid volume from the well. The invention is an isolation assembly that is inserted into the well. The isolation assembly is designed so that only a volume of fluid between the outside diameter of the isolation assembly and the inside diameter of the well over a fluid column height from the bottom of the well to the top of the active portion (lower annulus) is removed. A seal may be positioned above the active portion thereby sealing the well and preventing any mixing or contamination of inlet fluid with fluid above the packer. Purged well fluid is stored in a riser above the packer. Ports in the wall of the isolation assembly permit purging and sampling of the lower annulus along the height of the active portion."

R. Schalla, R. Smith, S. Hall, J. Smart, and G. Gustafson, Well Purge and Sample Apparatus and Method; U.S. Pat. No. 5,460,224 (24 Oct. 1995) disclose "The present invention specifically permits purging and/or sampling of a well but only removing, at most, about 25% of the fluid volume compared to conventional methods and, at a minimum, removing none of the fluid volume from the well. The invention is an isolation assembly with a packer, pump and exhaust, that is inserted into the well. The isolation assembly is designed so that only a volume of fluid between the outside diameter of the isolation assembly and the inside diameter of the well over a fluid column height from the bottom of the well to the top of the active portion (lower annulus) is removed. The packer is positioned above the active portion thereby sealing the well and preventing any mixing or contamination of inlet fluid with fluid above the packer. Ports in the wall of the isolation assembly permit purging and sampling of the lower annulus along the height of the active portion."

Other documents provide technological background regarding well structures and processes, such as: PompeHydropneumatique Immrgee Pour Le Pompage Ou Le Relevement En Niveua De Liquides, FRENCH Patent Publication No. 2 758 168; C. Gloodt, Method and Apparatus for Purging Water From a Whirlpool System, U.S. Patent Application Publication No. US 2001/0027573 A1; G. Last and D Lanigan, Sampling Instruments for Low-Yield Wells, U.S. Patent Application Publication No. US 2002/0166663 A1; R. Murphy, D. Jamison, and B. Todd, Oil Well Bore Hole Filter Cake Breaker Fluid Test Apparatus and Method, U.S. Patent Application Publication No. US 2003/0029230 A1; O. Mullins, T. Terabayashi, K. Kegasawa, and I. Okuda, Methods and Apparatus for Downhole Fluids Analysis, U.S. Patent Application Publication No. US 2003/0062472 A1; J. Binder, Pneumatic Pump Switching Apparatus, U.S. Patent Application Publication No. US 2003/0138556 A1; W. Van Ee, Liquid Depth Sensing System, U.S. Patent Application Publication No. US 2003/0140697 A1; P. Williams, Oil Well Formation Tester, U.S. Pat. No. 2,511,759; G. Maly and J. Brown, Well Fluid Sampling Device, U.S. Pat. No. 2,781,663; B. Nutter, Pressure Controlled Drill Stem Tester With Reverse Valve, U.S. Pat. No. 3,823,773; F. Jandrasi and H. Purvis, Slide Valve With Integrated Removable Internals, U.S. Pat. No. 3,964,507; E. Welch, Clean in Place Diaphragm Valve, U.S. Pat. No. 4,339,111; J. McMillin, G. Tracy, W. Harvill, and W. Credle, Pneumatically Powerable Double Acting Positive Displacement Fluid Pump, U.S. Pat. No. 4,354,806; W. Martin and S. Whitt, Down Hole Steam Quality Measurement, U.S. Pat. No. 4,409,825; B. Doremus and J-P Muller, Remote Hydraulic Control Method and Apparatus Notably for Underwater Valves, U.S. Pat. No. 4,442,902; E. Chulick, Multiple Point Groundwater Sampler, U.S. Pat. No. 4,538,683; W. Blake, Jacquard Fluid Controller for a Fluid Sampler and Tester, U.S. Pat. No. 4,573,532; W. Dickinson and C. Baetz, Two Stage Pump Sampler, U.S. Pat. No. 4,701,107; S. Burge and R. Burge, Apparatus for Time-Averaged or Composite Sampling of Chemicals in Ground Water, U.S. Pat. No. 4,717,473; J. Luzier, Groundwater Sampling System, U.S. Pat. No. 4,745,801; J. Jenkins, C. Jenkins, and S. Jenkins, Water Well Treating Method, U.S. Pat. No. 4,830,111; T. Zimmerman, J. Pop, and J. Perkins, Down Hole Tool for Determination of Formation Properties, U.S. Pat. No. 4,860,581; B. Welker, Purge Valve, U.S. Pat. No. 4,882,939; T. Zimmerman, J. Pop, and J. Perkins, Down Hole Method for Determination of Formation Properties, U.S. Pat. No. 4,936,139; R. Fiedler, Valve Pump, U.S. Pat. No. 5,161,956; R. Fiedler, Valve Pump, U.S. Pat. No. 5,183,391; Y. Dave and T. Ramakrishnan, Borehole Tool, Procedures, and Interpretation for Making Permeability Measurements of Subsurface Formations, U.S. Pat. No. 5,269,180; W. Heath, R. Langner, and C. Bell, Process Environment Monitoring System, U.S. Pat. No. 5,270,945; R. Nichols, M. Widdowson, H. Mullinex, W. Orne, and B. Looney, Modular, Multi-Level Groundwater Sampler, U.S. Pat. No. 5,293,931; R. Burge and S. Burge, Ground Water Sampling Unit Having a Fluid-Operated Seal, U.S. Pat. No. 5,293,934; E. Skinner, Pitless Adapter Valve for Wells, U.S. Pat. No. 5,439,052; W. Heath, R. Langner, and C. Bell, Process Environment Monitoring System, U.S. Pat. No. 5,452,234; G. Gustafson, Service Cable and Cable Harness for Submersible Sensors and Pumps, U.S. Pat. No. 5,857,714; R. Peterson, Deep Well Sample Collection Apparatus and Method, U.S. Pat. No. 5,934,375; G. Granato and K. Smith, Automated Groundwater Monitoring System and Method, U.S. Pat. No. 6,021,664; F. Patton and J. Divis, In Situ Borehole Sample Analyzing Probe and Valved Casing Coupler Therefor, U.S. Pat. No. 6,062,073; J. Divis and F. Patton, System for Individual Inflation and Deflation of Borehole Packers, U.S. Pat. No. 6,192,982 B1; F. Patton and J. Divis, Measurement Port Coupler for Use in a Borehole Monitoring System, U.S. Pat. No. 6,302,200 B1; W. Thomas and G. Morcom, Well Production Apparatus and Method, U.S. Pat. No. 6,454,010 B1; D. Mioduszewski, D. Fischer, and D. Kaminski, Bladder-Type Sampling Pump Controller, U.S. Pat. No. 6,508,310 B1; G. Last and D. Lanigan, Method and Apparatus for Sampling Low-Yield Wells, U.S. Pat. No. 6,547,004 B2; P-E Berger, V. Krueger, M. Meister, J. Michaels, and J. Lee, U.S. Pat. No. 6,581,455 B1—Modified Formation Testing Apparatus With Borehole Grippers and Method of Formation Testing; and G. Granato et al; *Automated Ground-Water Monitoring With Robowell: Case Studies and Potential Applications;* Proc. SPIE Int. Soc. Opt. Eng.; vol. 4575, p. 32–41; Conf. SPIE; Nov. 1–2, 2001; Newton, Mass., USA;© 2003, IEE.

BARCAD® well systems, available through Besst, Inc., of Larkspur, Calif., comprise groundwater-sampling instruments which are designed for permanent installation at a fixed level in a uncased, backfilled borehole borehole and use gas displacement pumping. The sampler contains a one-way check valve and a porous filter, through which water can be extracted from the formation and conducted to the surface, through a narrow diameter sample return line. A BARCAD® system is placed at the bottom of a small, typically 1 inch, diameter PVC or stainless steel riser pipe, which acts as both a reservoir and as a pressure vessel during purging and sampling operations. A one-way check valve is an attached integral component of a BARCAD® system. A BARCAD® system is purged and sampled by first sealing the top of the riser pipe with a cap, which has an inlet for compressed gas and also allows the sample return line to extend out through the cap. The end of the sample return line is open to atmospheric pressure, while the connection between the outside of the sample return line and the cap is tightly sealed. Pressurized inert gas is introduced via the inlet into the riser pipe, which pushes down on the water inside the riser pipe, and closes the check valve. The gas pressure then forces the water up the sample return line to the surface. When the riser pipe has been emptied of water, the tube connecting the inert gas source to the cap inlet is opened to the atmosphere and the compressed gas inside the riser pipe then vents back down to atmospheric pressure. Formation water pressure then opens the check valve and refills the riser pipe to the formation's piezometric water level.

Prior BARCAD®-type direct pressure pneumatic sampling systems have an integral valve which cannot be removed without the removal of the entire system, which includes the riser pipe, the valve, and the primary filter or screen. When Barcad systems are buried directly in a borehole, removal is not possible, and can be difficult when a BARCAD® system is placed inside of a well.

It would be advantageous to provide a purging or sampling system sampling system includes a valve which may be removed after the system has been installed in a well or borehole, such as to allow for replacement of a damaged, stuck, or otherwise failed valve from an implanted Barcad type sampling system, without removal of the system filter or riser pipe, or to temporarily remove the valve from a Barcad type system to allow for better aquifer testing than is possible with the valve in place. The development of such a purging or sampling system would constitute a significant technological advance.

Gas displacement pumps are also used as purge pumps in conjunction with bladder type sampling pumps. The purge pump and bladder pump are hung near each other and below static water level inside of a monitoring well. Such purge pumps consist of a cylindrical chamber with a one-way check valve at the bottom, and a pair of tubes which extend from the top of the chamber to the ground surface. One tube is the gas inlet line which ends at the top of the chamber. A second line comprises a water return line, which enters the top of the chamber and ends near the bottom of the chamber. Compressed gas or air is pushed down the gas in line, which closes the valve and forces the water inside the chamber up the water return line to the ground surface. The valve in such systems is an integral part of the chamber. A limit for such purge pumps is that the diameter of the return line represents a set of trade offs. If the diameter is small, the flow rate is reduced, but there is little mixing between the water and the compressed gas powering the system. With an increased diameter, the flow rate increases, but the gas usage rapidly increases, due to gas mixing into the water in the return line once the pump chamber has been emptied. These problems become more significant with increasing pumping depth which is one reason such pumps are generally used at shallow depths, typically 250 feet or less.

While bladder type sampling pumps also operate on the gas displacement principle, bladder pumps differ from conventional purge pumps, as described above, in that the gas used to drive the system in isolated from direct contact with the fluid being pumped by an expandable bladder inside of the cylindrical chamber. The valve and the bladder are integral parts of the cylindrical chamber.

The disclosed prior art systems and methodologies thus provide sampling and purging systems for well structures, but fail, in those cases where the riser pipe is part of the pump structure, to provide sampling or purging structures which provide partial removal of a pump. For example, if a purge or sampling system where the well's riser pipe is part of the pump is required to be removed, the riser pipe and surrounding structure must also be removed, which is typically impractical, impossible, or too costly, such that the borehole or, in the case of a multiport sampling system, the sampling point is typically abandoned.

The disclosed systems are also limited in that they use a single sample return line to bring water to the surface and are thus limited in flow rates. It would be advantageous to provide multiple sample return lines to enhance flow rates from gas displacement pumps.

It would be advantageous to provide a structure and method which allows existing small diameter wells, or piezometers, to be temporarily or permanently retrofit for direct pressure pneumatic pumping for purging and sampling. The development of such a purging or sampling system would constitute a major technological advance.

It would be advantageous to provide a structure and method which allows existing wells, such as small diameter wells, or piezometers, to be temporarily or permanently retrofit for direct pressure pneumatic, i.e. gas displacement, pumping for purging and sampling. The development of such a purging or sampling system would constitute a major technological advance.

Furthermore, it would be advantageous to provide a structure and method which allows placement of BARCAD® type sampling systems, by direct push methods, which can be purged and sampled by direct pressure pneumatic methods and have post installation replaceable valves. The development of such a purging or sampling system would constitute a further technological advance.

In addition, it would be advantageous to allow placement of small diameter wells inside of existing wells to act as sampling pumps whose valve can be replaced without removing the small diameter well's screen, primary filter or riser pipe. The development of such a system would constitute a further technological advance.

As well, it would be advantageous to allow for the removal of the direct pressure pneumatic system's valve without removing the well's riser pipe, primary filter or screen. The development of such a system would constitute a further technological advance.

SUMMARY OF THE INVENTION

A method and apparatus is provided for reducing the purge volume of a well during purging and sampling operations. In some system embodiments, the apparatus can be retrofitted to existing small diameter wells, typically wells 2 inches or less in diameter, and piezometers. A further embodiment provides a method and apparatus for using direct pneumatic pressure to purge and sample small diameter wells using a removable valve. This aspect of the invention allows a primary valve of a direct pneumatic pressure pump, i.e. gas displacement pump to be withdrawn through the top of the inside of a pressure holding structure (typically the riser pipe), without removing the riser pipe or the system's primary inlet structure, e.g. filter, screen, or other external fluid entry ports. The invention allows fitting or retrofitting small diameter wells with valves for direct pneumatic pressure purging and sampling. Other embodiments include sealing a removable valve at the bottom of a riser pipe, sealing a removable valve at or above the bottom of a riser pipe, remotely attaching a tool at the top of a removable valve, withdrawing a direct pneumatic pressure pump system's primary valve through the inside of the inside pump's pressure holding structure without removing the riser pipe, and attaching a direct pneumatic pressure pump system's sample return line to its primary valve. Further embodiments include a multiple return line pneumatic pump/well, which allows the use of multiple return lines on a pneumatic pump when used to pump water from very deep wells where piezometric surface of the water is also deep, as well as other uses for direct pressure pneumatic pumping and sampling.

DETAILED DESCRIPTION OF PREFERRED EMBODIMENTS

Figure 1:
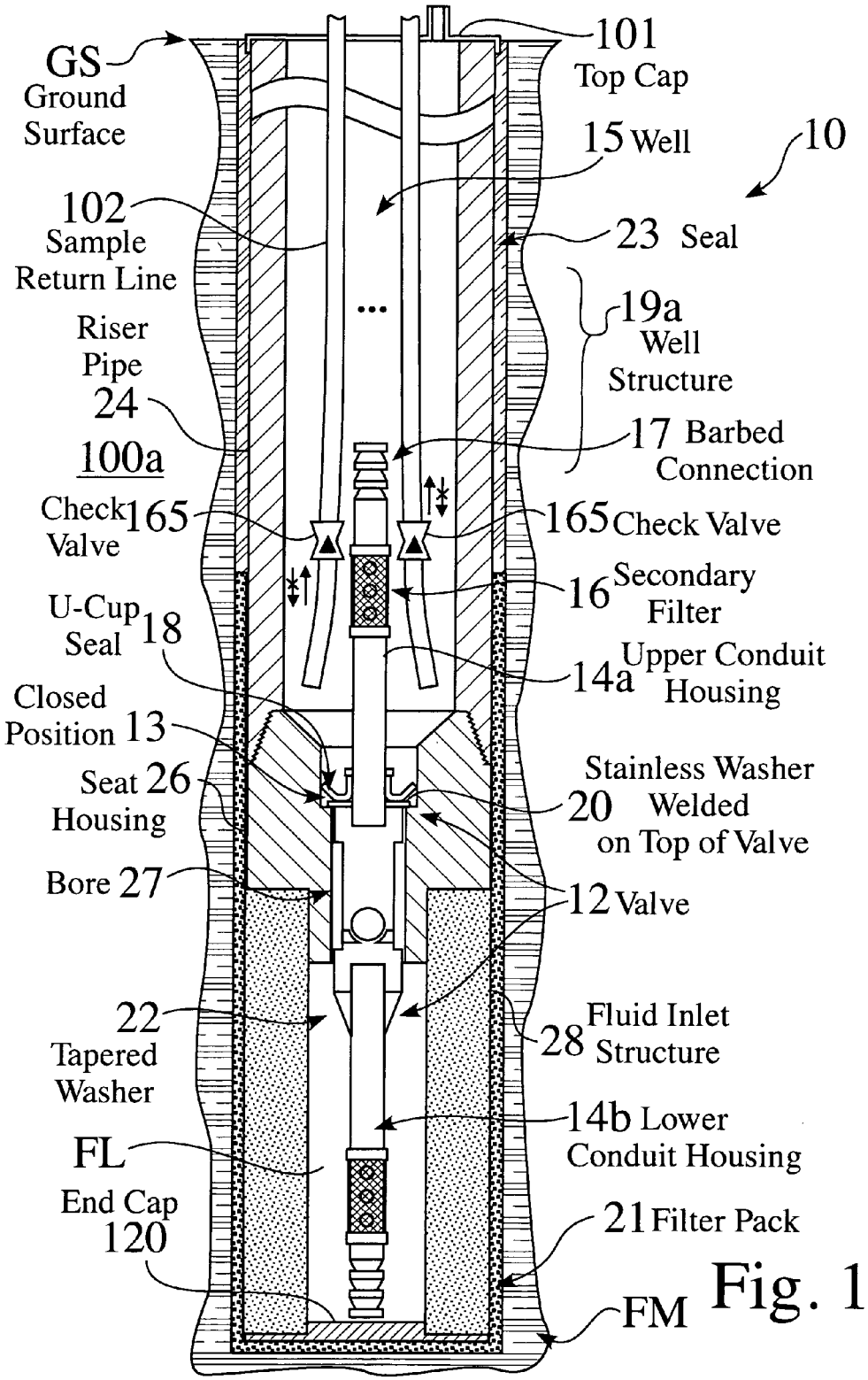
FIG. 1 is a partial cutaway view of a valve and housing with U-Cup in a seated position.
Figure 2:
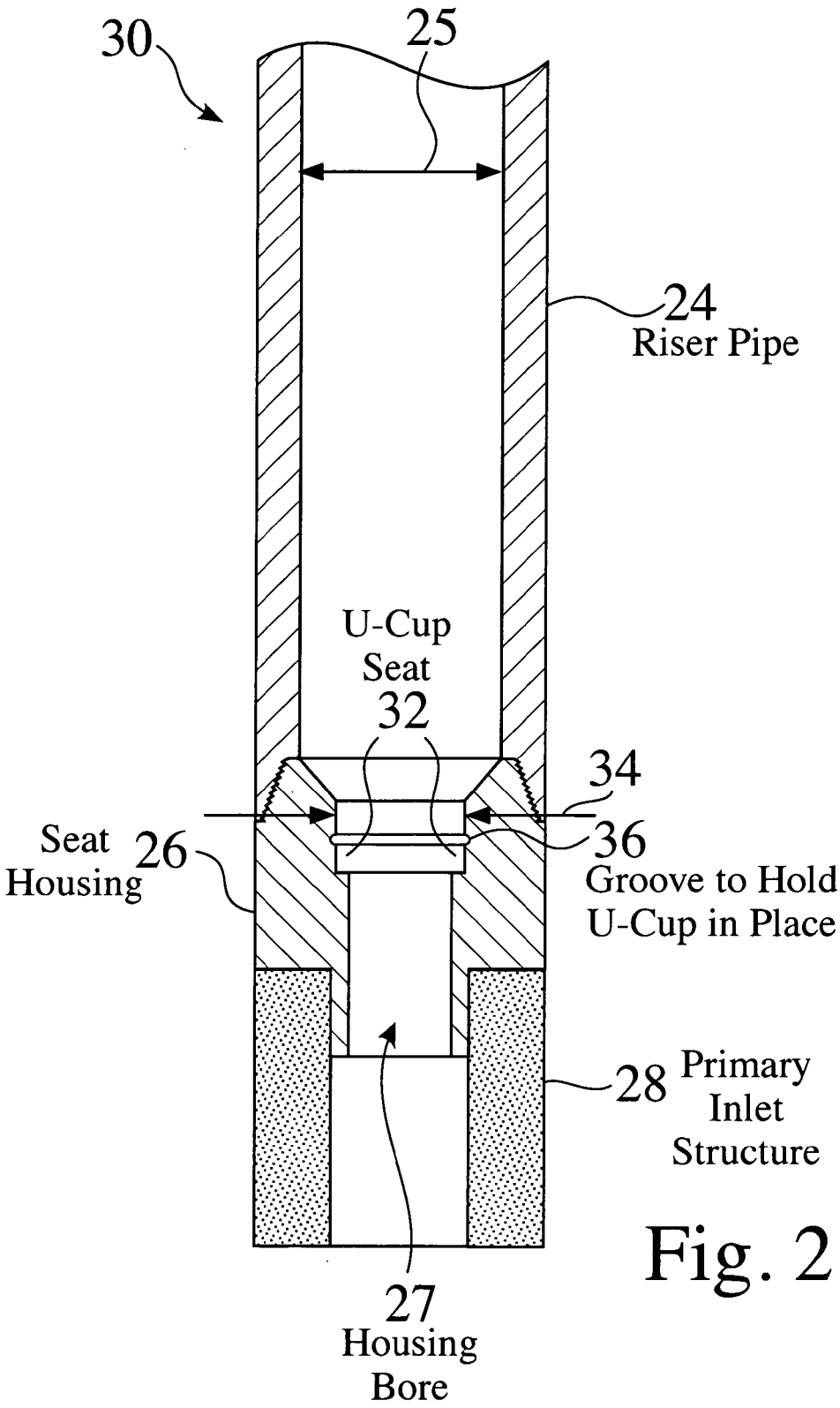
FIG. 2 is a u-cup seat, riser pipe, and primary filter.
Figure 3:
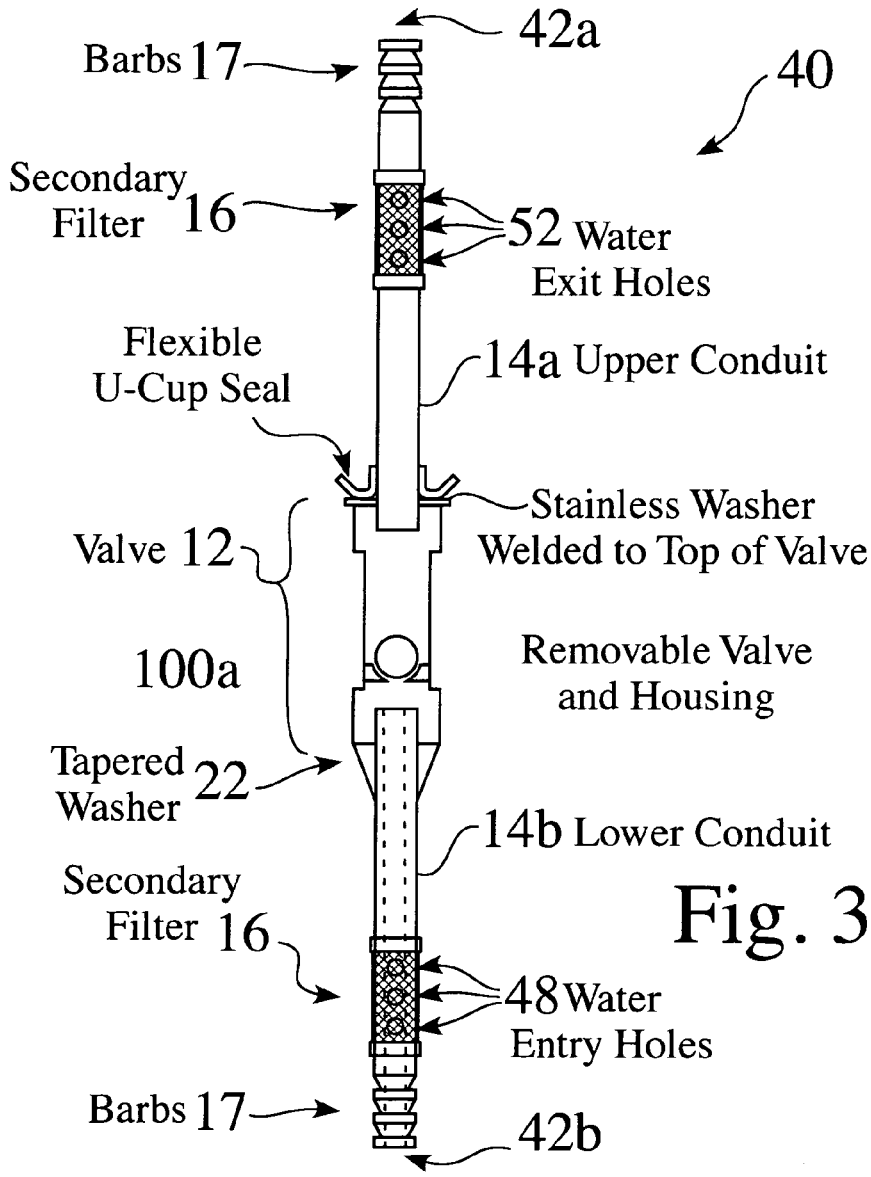
FIG. 3 is a side cutaway view of a removable valve.

FIG. 1 is a partial cutaway view 10 of a direct pressurization system 100*a* comprising a valve 12 having U-cup seal 18 in a closed, i.e. seated position 13 within a u-cup seat 32 (FIG. 2) within a seat housing 26 located at the lower end of a riser tube 24, for wells that have a built-in valve seat 32. FIG. 2 shows a structure 30 comprising a seat housing 26 having a u-cup seat 32, a riser pipe 24, and primary filter 28. FIG. 3 is a side cutaway view of a removable valve assembly 40.

As seen in FIG. 1, an upper conduit 14*a* extends through the U-cup seal 18, which is adapted to seal against the seat 32. As seen in FIG. 2, the well structure 30 comprises a hollow riser pipe 24, which extends to and is fixedly attached to a seat housing 26. The seat housing 26 includes a bore 27 defined therethrough. The seat housing bore 27 includes a seat 32, e.g. such as a U-cup seat 32, whereby a valve 12 (FIG. 1) may be located, to provide controllable closure 13 (FIG. 1).

As seen in FIG. 1 and FIG. 3, a one-way check valve 12 is attached to a hollow conduit, i.e. housing 14, such as an upper conduit 14*a* and lower conduit 14*b*, which is typically comprised of metal or plastic. In some embodiments 10, the conduit 14 includes a barbed connection 17 at one or both ends 42*a*,42*b*, for ease of removal.

The lower conduit 14*b* and/or the lower end of the valve 12 shown in FIG. 3 are preferably tapered 22, to help guide the conduit 14*b* into the seat 32 and bore 27 of the seat housing 26, which is located at the bottom of the well riser pipe 24 and above the screen or primary filter 28.

The diameter 34 (FIG. 2) of the outer edge of the U-cup 32 is preferably smaller than the inside diameter 25 of the riser pipe 24, so that water WT can flow past the seal 18 when the valve is lifted off the seat 32. When the valve 12 and housing 14 are in place on the seat 32, as seen by the closed position 13 in FIG. 1, the seal 18 prevents water WT (FIG. 1) from flowing around the outside of the housing 14 from the riser pipe 24 and into the well's screen or primary filter 28, located below the U-cup seal 18.

Water WT flowing up from the well screen or primary filter 28 into the riser pipe 24 flows through the housing bore 27 and through the check valve 12. The valve 12 may be located above, below, or proximate to the U-cup seal 18. As seen in FIG. 3, the valve 12 is preferably protected from sand particles within water WT by secondary filters 16, one near each conduit end 14*a*,14*b* of the housing 14.

As seen in FIG. 3, an upper conduit 14*a* and a lower conduit 14*b* can be removably attached to the removable valve 12. The conduits 14 typically comprise one or more water entry holes 48, as well as a secondary filter or screen 16 which surround the holes 48. The conduits 14*a*, 14*b* shown in FIG. 3 also include barbed ends 17.

The structures 10,40 shown in FIG. 1 and FIG. 3 allow for the placement of small diameter sampling points or wells which have been equipped with a U-cup seat 32 prior to installation in the subsurface, and provide a direct pressure, i.e. gas displacement pneumatic pumping system 100*a* for purging and sampling. The structures 10,40 valves can be placed and removed from within a well 15, e.g. a well structure 19*a*, such as small diameter wells, or can be placed directly in the subsurface sediments, by direct push or other drilling methods, or can be buried directly in an open borehole, which can then be purged and sampled by direct pressure pneumatic methods after conventional well development. The structures 10,40 shown in FIG. 1 and FIG. 3 may also be hung or placed within a larger well, such as with sand, so as to act as a pump within the larger well. As well, the structure 40 can readily be replaced, without removing the small diameter well's screen/primary filter, or riser pipe. The well structure 19*a* as well as all of the other components, such as the exemplary structure 10,40 shown in FIG. 1, are typically installed in vertical orientation, but may also be installed at any other angle off of vertical. These structures, 10,40 may also be installed with more than one set in a borehole, allowing for different sampling points at different depths in the subsurface.

As seen in FIG. 1, the system structure 40 is typically placed in a well bore 15 having a surround formation FM. A filter pack 21, such as sand is typically located at the lower region of the well surrounding the primary filter/screen 28. A seal 23, such as cement grout, or clay 23 typically surround the riser pipe 24 and extends from the filter pack FP to the ground surface GS.

Figure 4:
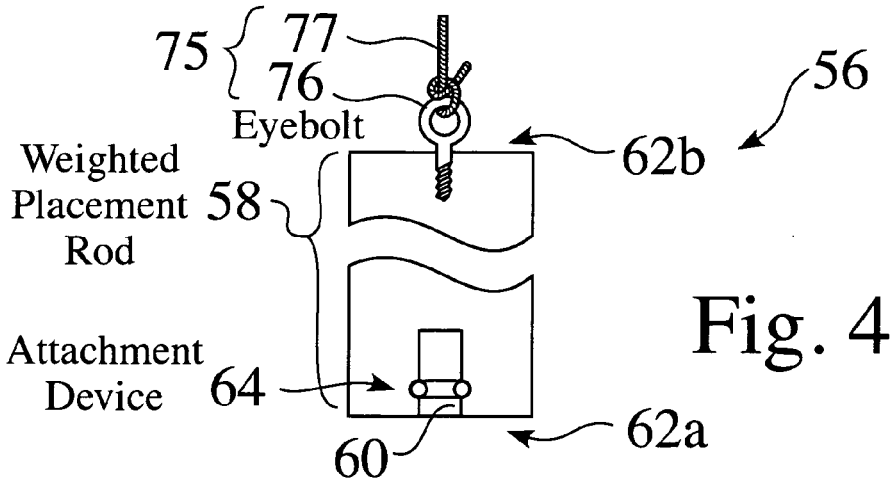
FIG. 4 is a partial side cutaway view of a placement tool for a removable valve.

FIG. 4 is a partial side cutaway view of a placement tool 56 for a removable valve assembly 40. The valve and housing assembly 40 are controllably positionable into the well 15, through the use of a placement tool 56. The placement tool 56 shown in FIG. 4 comprises a rod 58, which is lowerable into the riser pipe 24 of a well structure 15. The rod 58 shown in FIG. 4 includes means for vertical displacement 75, such as an eyelet 76 and attached cord 77. In those cases where the structure 10 is installed at an angle other than vertical, a semi rigid tube, rod or cable 77 is preferably used in place of the cord 77, which allows the placement tool 56 to be pushed down the riser pipe 24, in order to overcome any friction resistance between the rod 58 with the attached removable valve assembly 40 and/or the wall of the riser pipe 24.

The placement tool 56 shown in FIG. 4 also includes an open hole 60 defined on the lower end 62*b* of the rod 58. An attachment device 64 is preferably located within the defined hole 60, which holds the barbs 17 on the upper conduit 14*a*, with sufficient force to hold the weight of the valve and housing assembly 10. The attachment device 64 shown in FIG. 4 may be comprised of any of variety a friction device, e.g. an o-ring, a magnetic device, a pneumatically actuatable device, and an electronically actuatable holding device.

During placement of a valve and housing assembly 40, the weight of the placement tool 56 is typically sufficient to push the U-cup seal 18 into the U-cup seat 32. In some installations, such as angled installations, the tool 56 is preferably pushed down the riser pipe 24, to overcome friction with the wall of the riser pipe 24. In the placement tool 56 shown in FIG. 4, the friction device has a weaker hold on the housing 14*a* than the holding force between the U-cup seal 18 and seat 32. Once the valve assembly 40 is positioned into the valve seat 32, the placement tool 56 is readily released from the barbed end 17 of the upper housing 14*a*, such that the placement tool 56 can be removed from the well 15.

As seen in FIG. 2, a U-cup seat 32 may preferably include a slight groove 36, to catch the upper edge of the U-cup seal 18, to help hold the U-cup seal in place as the placement tool 56 is withdrawn.

Figure 5:
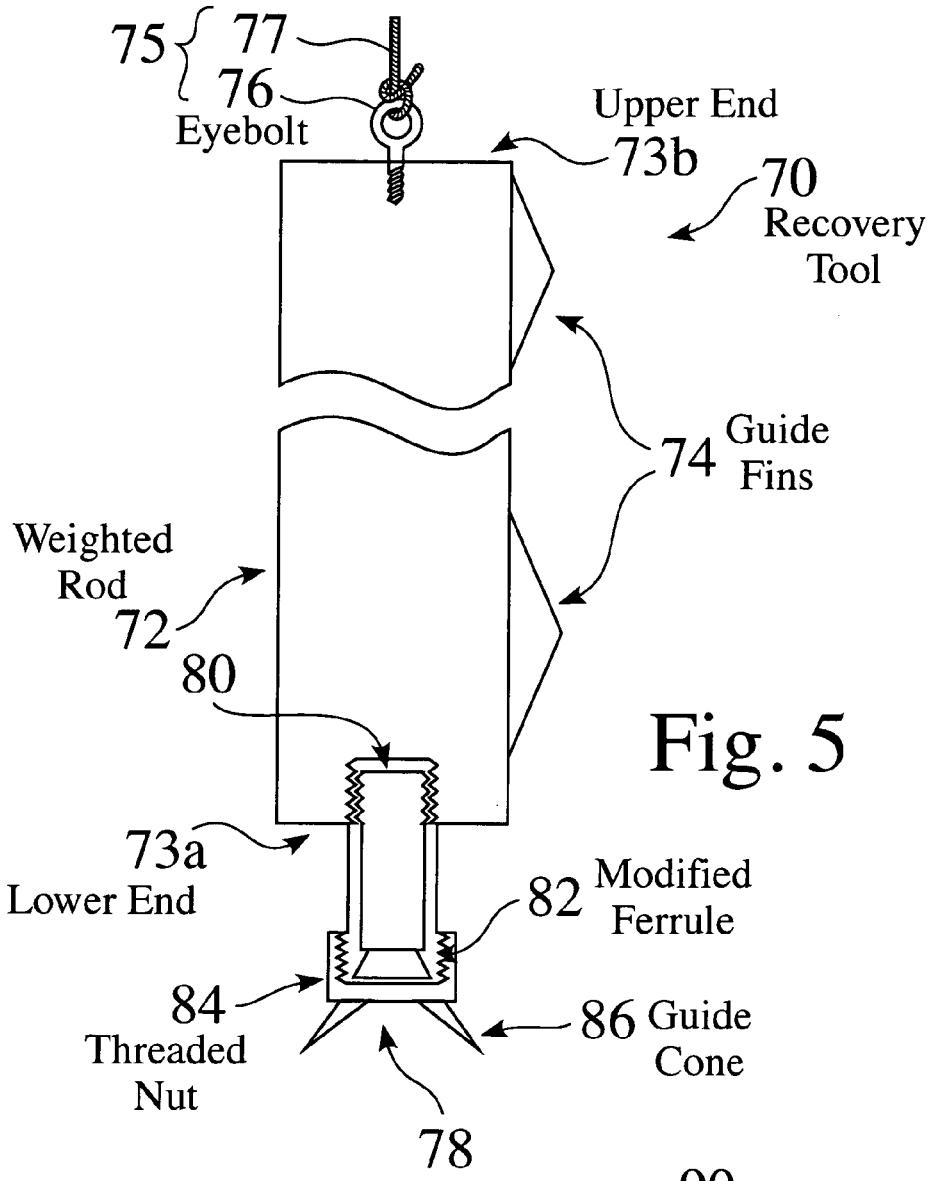
FIG. 5 is a partial side cutaway view of a recovery tool.
Figure 6:
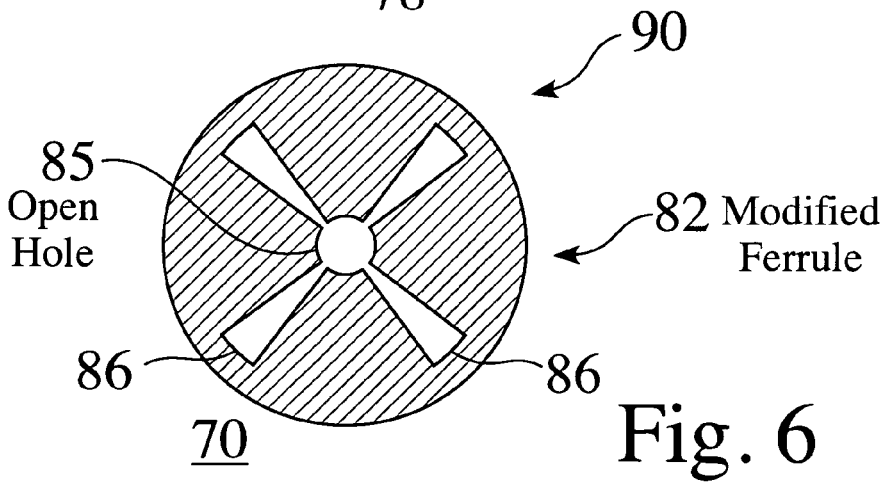
FIG. 6 is an detailed top view of a recovery tool.

FIG. 5 is a partial side cutaway view of a recovery tool 70. FIG. 6 is a detailed top view of a modified ferrule 82 for a recovery tool 70. The valve assembly 40 is removable from the well structure 15, through the use of a recovery tool 70, whereby the valve assembly 40 can be pulled away from the seat 32, and lifted up to the ground surface GS by use of the recovery tool 70.

The recovery tool 70 shown in FIG. 5 comprises a weighted rod 72, having a lower end 73*a* and an upper end 73*b*, which is lowerable into the riser pipe 24 of a well structure 15. The rod 58 shown in FIG. 5 includes means for vertical displacement 75, such as an eyelet 76 and attached cord 77. In those cases where the structure 10 is installed at an angle other than vertical, a semi rigid tube, rod or cable 77 is preferably used in place of the cord 77, which allows the rod 72 to be pushed down the riser pipe 24, to overcome any friction resistance between the rod and the wall of the riser pipe 24. In such cases, the rod 77 may preferably be modified to reduce friction, such as to keep the weight to a minimum, or to include a coating or plating layer.

The rod 72 shown in FIG. 5 has several fins 74 near the top and bottom of the rod 72 and running parallel to the length of the rod 72, to keep the rod 72 centered in the riser pipe 24 as it is being lowered or pushed. The rod 72 shown in FIG. 5 also includes an open hole 80 defined on the lower end 73*a* of the rod 72.

A modified ferrule 82 or similar structure is located inside the hole 80, and is slidably engagable to the upper barbed end 17 of the upper conduit 14*a*, as the recovery tool 56 is lowered onto the upper conduit 14*a*. The ferrule 82 is held in place by a threaded nut 84 with an open hole 85 (FIG. 6) defined on the end of the nut 84. The nut 84 has an open cone 86 defined on the lower end 78, to help guide the upper barbed end 17 of the upper conduit 14*a* into the hole 85. The upper edges of the modified ferrule 82 engage with the barbs 17 of the upper conduit 14*a*, and allow the valve housing 14 to be pulled free from the valve seat 32.

Figure 7:
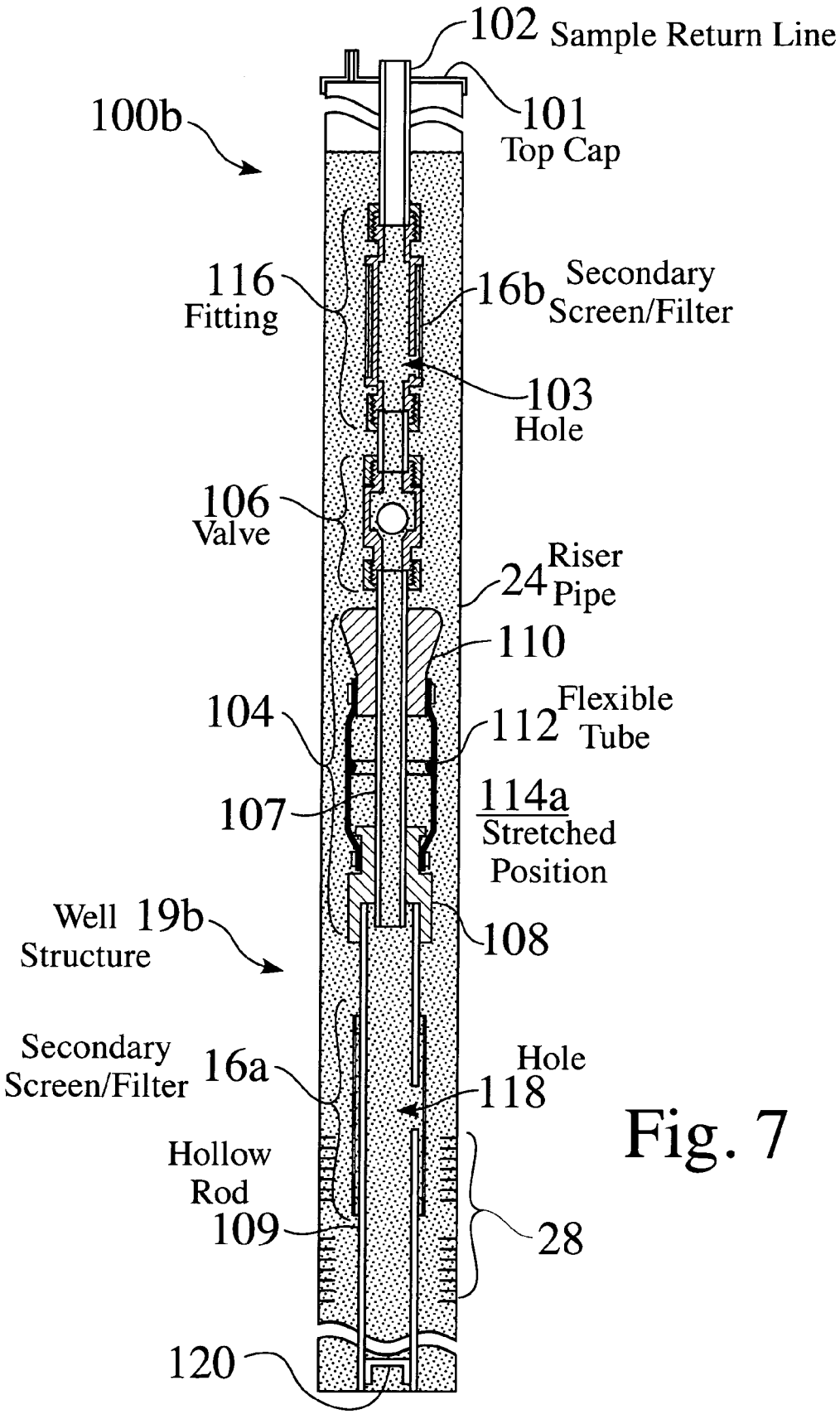
FIG. 7 is a partial side cutaway view of a rubber tube embodiment in a first stretched position.
Figure 8:
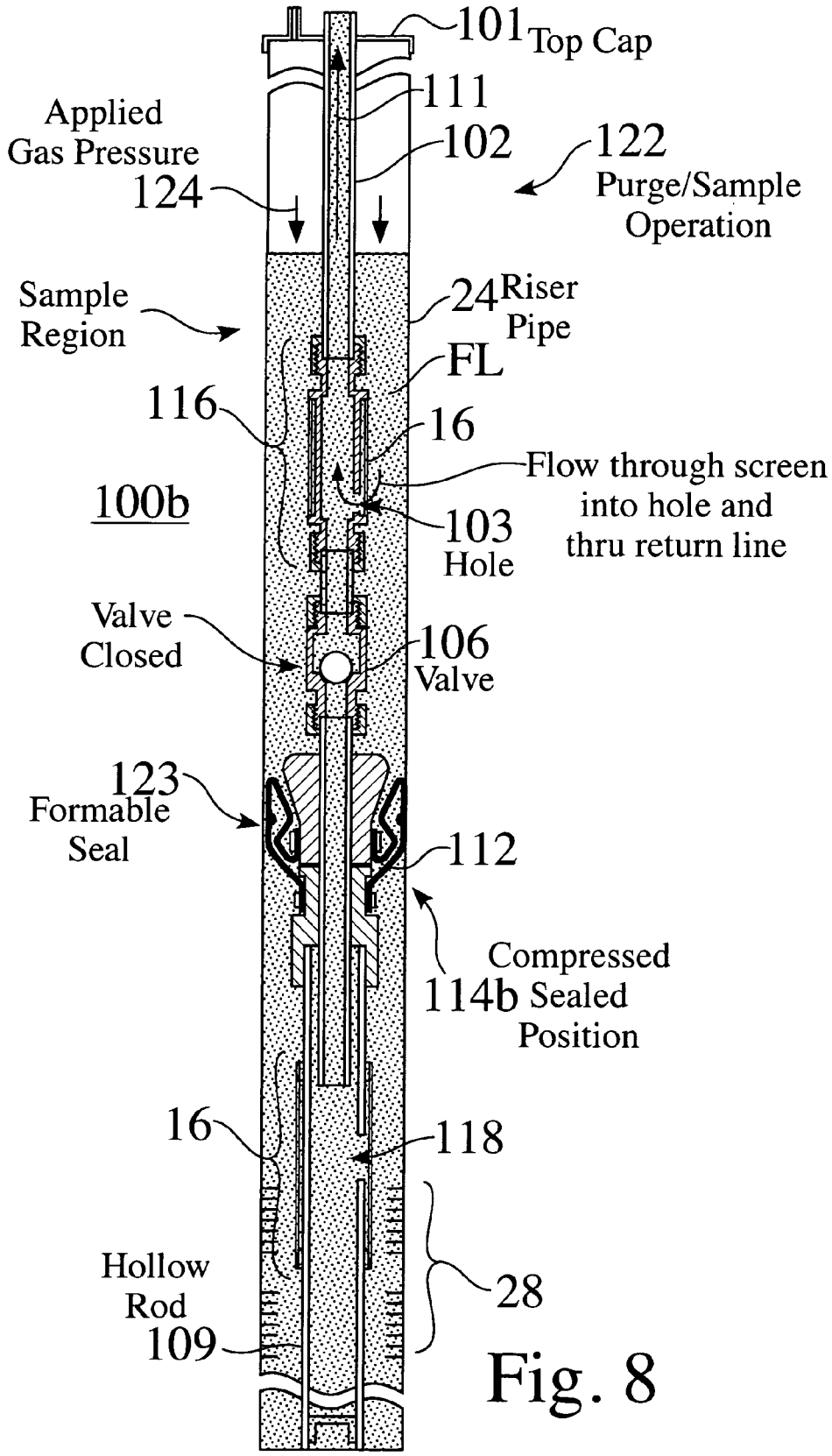
FIG. 8 is a partial side cutaway view of a rubber tube embodiment in a second sealed position.
Figure 9:
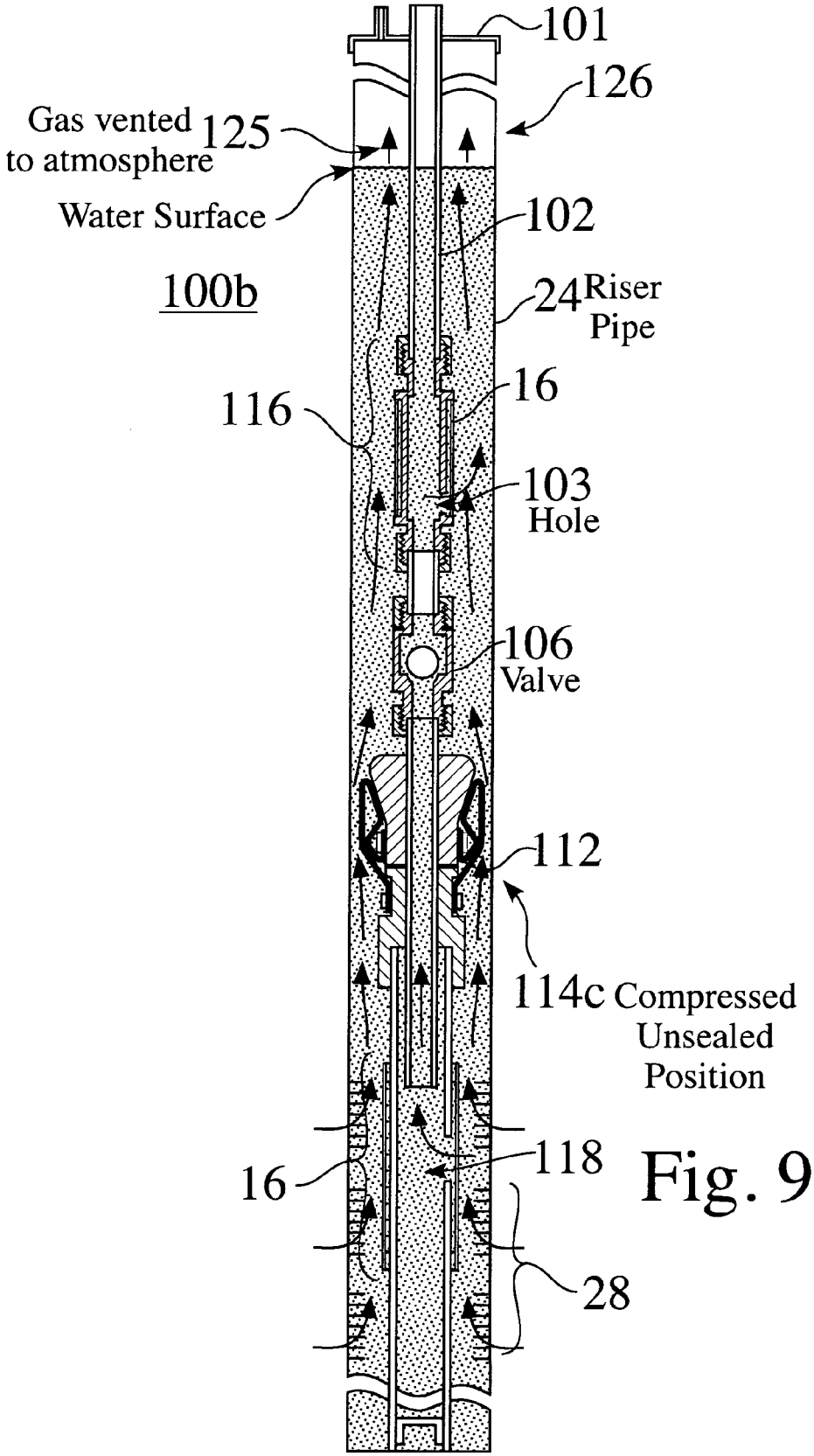
FIG. 9 is a partial side cutaway view of a rubber tube embodiment in a third unsealed position.

FIG. 7 is a partial side cutaway view of a direct pressurization pumping system 100*b* comprising a flexible tubular seal 112, in a first stretched position 114*a*, which can be used for retrofitting wells and piezometers which do not have a built in valve seat. FIG. 8 shows a purge/sample operation 122 of a direct pressurization system 100*b* in a second sealed position 114*b*. FIG. 9 is a partial side cutaway view of a direct pressurization system 100*b* in a third unsealed position 114*c*. The packaged direct pressurization system 100*b* provides a sealing assembly 104, such that the system 100 can be used for purging and sampling for well structures 19*b* which do not have an existing valve seat 32.

A hollow rod 109 extends from below a valve 106, through the screened interval 28 and to the bottom of the well 19*b*. This rod 109 stops the lower section 104 from being lowered into the screened interval when the system 100*b* is initially lowered into the well. The length of rod 109 is greater than the distance from the top of the screened interval 28 to the bottom of the well. The rod 109 also prevents the valve 106 and seal from being pushed into the screened zone 28 by the pneumatic pressure 124 used to purge and/or sample 122 (FIG. 8) the well structure 19*b*.

The valve 106 is attached to the bottom of a hollow sample return line 102. The two hollow rod sections 107,109 are attached by a sliding linkage 104 having a flexible tubular seal 112 comprising of rubber or other flexible material. The lower hollow rod 107 is attached to section 110, while the upper hollow rod 107 is attached to the lower section 108, such that the upper hollow rod 107 moves in relation to the lower hollow rod 109 when the sections 108,110 are moved in relation to each other.

The diameter of the tube seal 112, in the stretched position 114*a*, is such that it can slip through the casing, allowing water FL to flow around it, as seen in FIG. 7. The top of the lower hollow rod or tube 107 is attached, either directly or through one or more fittings, e.g. 106,116, to the sample return line 102, such as a flexible tube comprising any of plastic, nylon, fluoropolymer, e.g. Teflon™, or similar material, or alternately a metal tubing., e.g. such as but not limited to stainless steel.

As seen in FIG. 7, the first stretched position 114*a* can be used to raise or lower the direct pressurization system 100*b* into a well structure 19*b*, or when an operator lifts up on the sample return line 102, such as to collapse a formable seal 123 (FIG. 8), to refill the riser pipe with fluid FL, e.g. water WT.

As seen in FIG. 8, when the system 100*b* is lowered to the bottom of a well 19*b*, the weight of the upper hollow rod 110 pushes down on the rubber tube 112, causing it to partially invert and push out against the wall of the casing, forming a seal 123. A filter 16*a* below the valve 106 protects the valve 106 from being jammed by sand or silt particles.

As seen in FIG. 7, FIG. 8, and FIG. 9, an end cap 101 is located at the upper end of the riser pipe 24, such that pressurization 24 (FIG. 8) and venting (FIG. 9) can be controllably applied.

In some system embodiments 100*b*, the valve 106 shown in FIG. 7, FIG. 8, and FIG. 9 is attached to the sample return line 102, so that a user USR can readily pull on the sample return line 102 to retrieve the valve 106 to the surface GS. When the sample return line 102 is attached to the valve 106, there is a hole 103 defined on the side of the connector 116 that links the valve 106 to the end of the sample return line 102, which allows water FL from the inside of the riser pipe 26 to enter the sample return line 102 during purging and/or sampling 122. As seen in FIG. 8, during a purging and/or sampling operation 122, fluid FL in the riser pipe 24 at or above the hole 103 flows through the upper screen 116, entering the hole 103 and flowing 111 through the sample return line 102, when the valve 106 is in a closed position. The same hole or holes 103 are directly linked to the top of the valve 106, which allows water FL passing through the valve 106 to pass into the riser pipe 26.

As seen in FIG. 9, when back pressure is bled off after a purge or sampling cycle, water FL is able to flow into the riser pipe 24, by flowing in the hole 118, up the hollow rod 109, through the valve 106, and out the hole 103 into the riser pipe 24, and/or by pushing the folded seal 112 out of the way from below. In some system embodiments 100*b*, water FL can flow past a seal 112 which is loosened when gas pressure in the riser pipe 24 is vented 125. In other system embodiments 100*b*, water FL does not flow past the seal 112 upon venting. The seal 112 can alternately comprise a fluid filled tube 112, or a fluid filled double walled tube 112.

Figure 10:
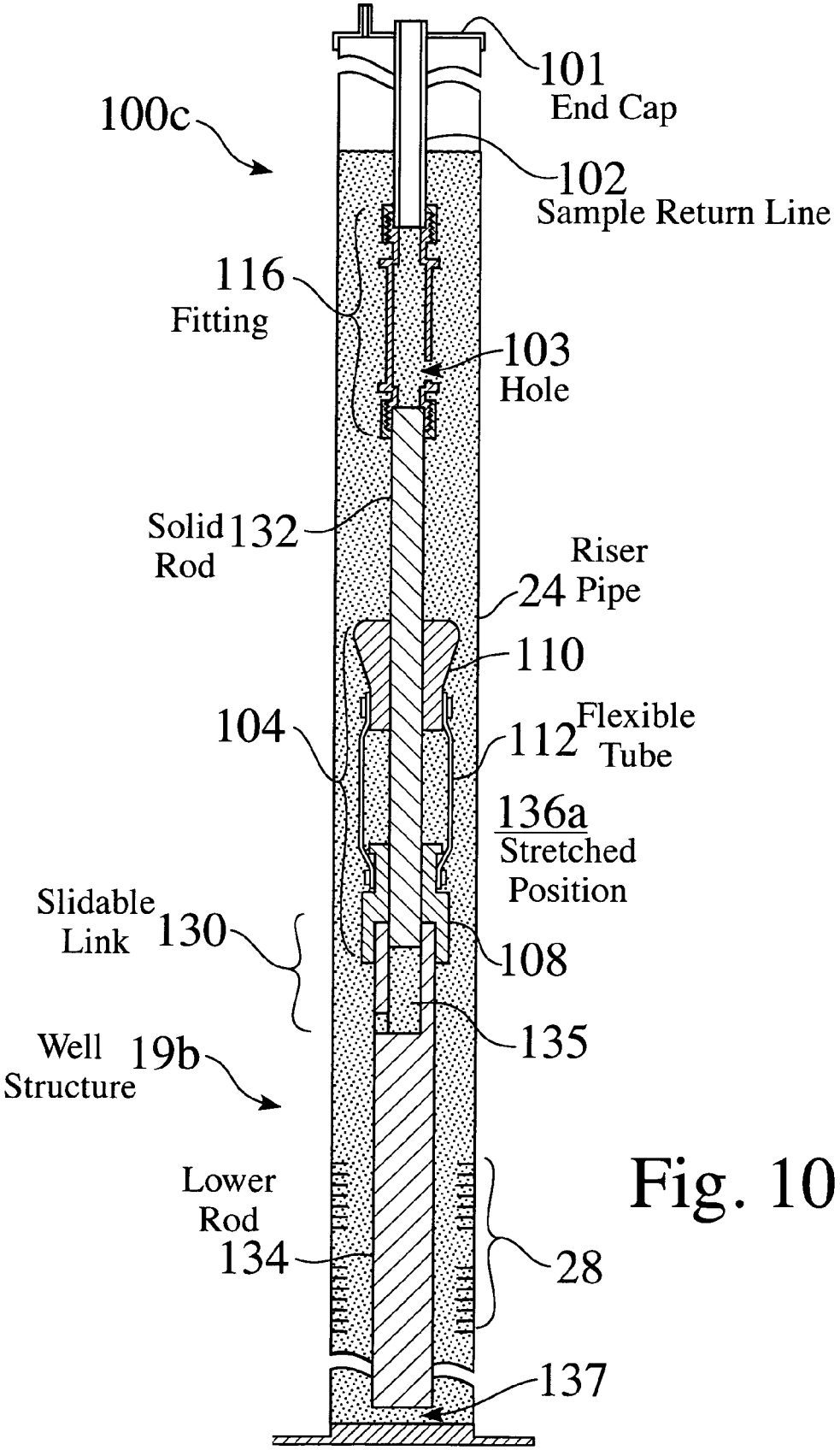
FIG. 10 is a partial side cutaway view of a solid rod slidable link rubber tube embodiment in a first stretched position.
Figure 11:
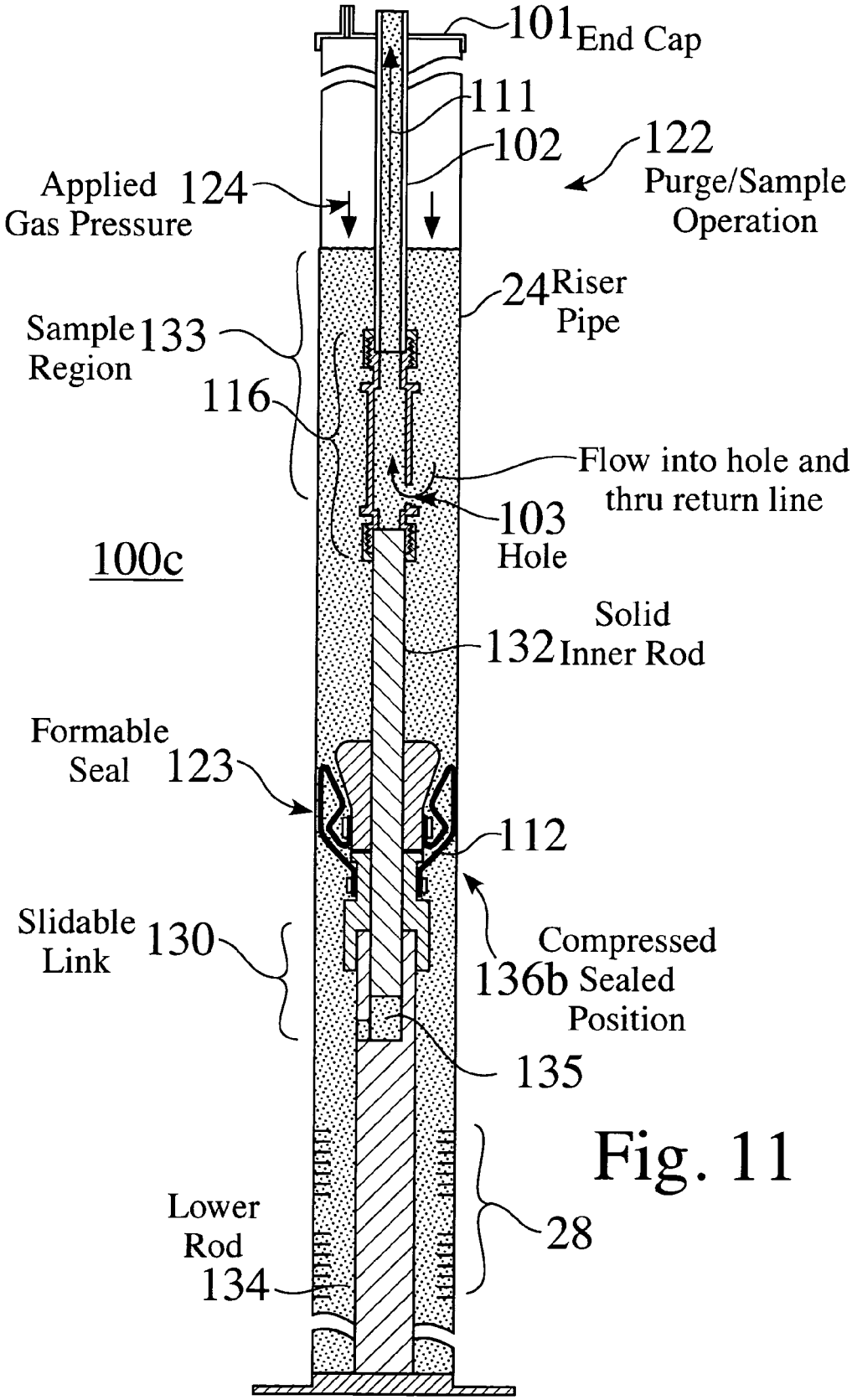
FIG. 11 is a partial side cutaway view of a solid rod slidable link rubber tube embodiment in a second sealed position.

FIG. 10 is a partial side cutaway view of a direct pressure pumping system 100*c* comprising a flexible tubular seal 112, in a first stretched position 136*a*, which can be used for retrofitting wells and piezometers which do not have a built in valve seat. The direct pressurization system 100*c* comprises a solid rod slidable link and tubular seal 112. FIG. 11 is a partial side cutaway view of a direct pressure pumping system 100*c* embodiment in a second sealed position 136*b*.

The lower rod 134 is attached to section 108, while the upper solid rod 132 is attached to the upper section 110 and to the fitting 16*b*, such that the upper solid rod 132 moves in relation to the lower rod 134, to form a slidable link 130 within a bore 136, when the sections 108,110 are moved in relation to each other. In operation, as the direct pressurization system 100*c* is raised or lowered within a rider pipe 24, the direct pressurization system 100*c* is in a first stretched position 136*a*. When the direct pressurization system 100*c* is lowered such that the lower end 137 of the lower rod 134 contacts the end cap 120 of the well structure, the direct pressurization system 100*c* is controllably movable to a second sealed position 136*b*.

As seen in FIG. 11, in the second sealed position 136*b*, during the discharge phase of a purging and/or sampling operation 122, fluid FL in the riser pipe 24 at or above the hole 103 flows through the upper screen 16, entering the hole 103 and flowing through the sample return line 102. When pressure is bled off after a purge or sampling cycle, water FL is able to flow into the riser pipe 24, by either pushing the folded seal 112 out of the way from below or by having the operator lift up on the sample return line 102, thus collapsing the seal.

While the disclosed direct pressurization systems 100*b*, 100*c* are described as being replaceably installed and used within wells and piezometers which do not have a built in valve seat, the structures 100 described herein may alternately be, with their own riser pipe and fluid inlet structures, hung or placed within the riser pipe, such as with sand, so as to act as a pneumatic pump within the larger well.

Figure 12:
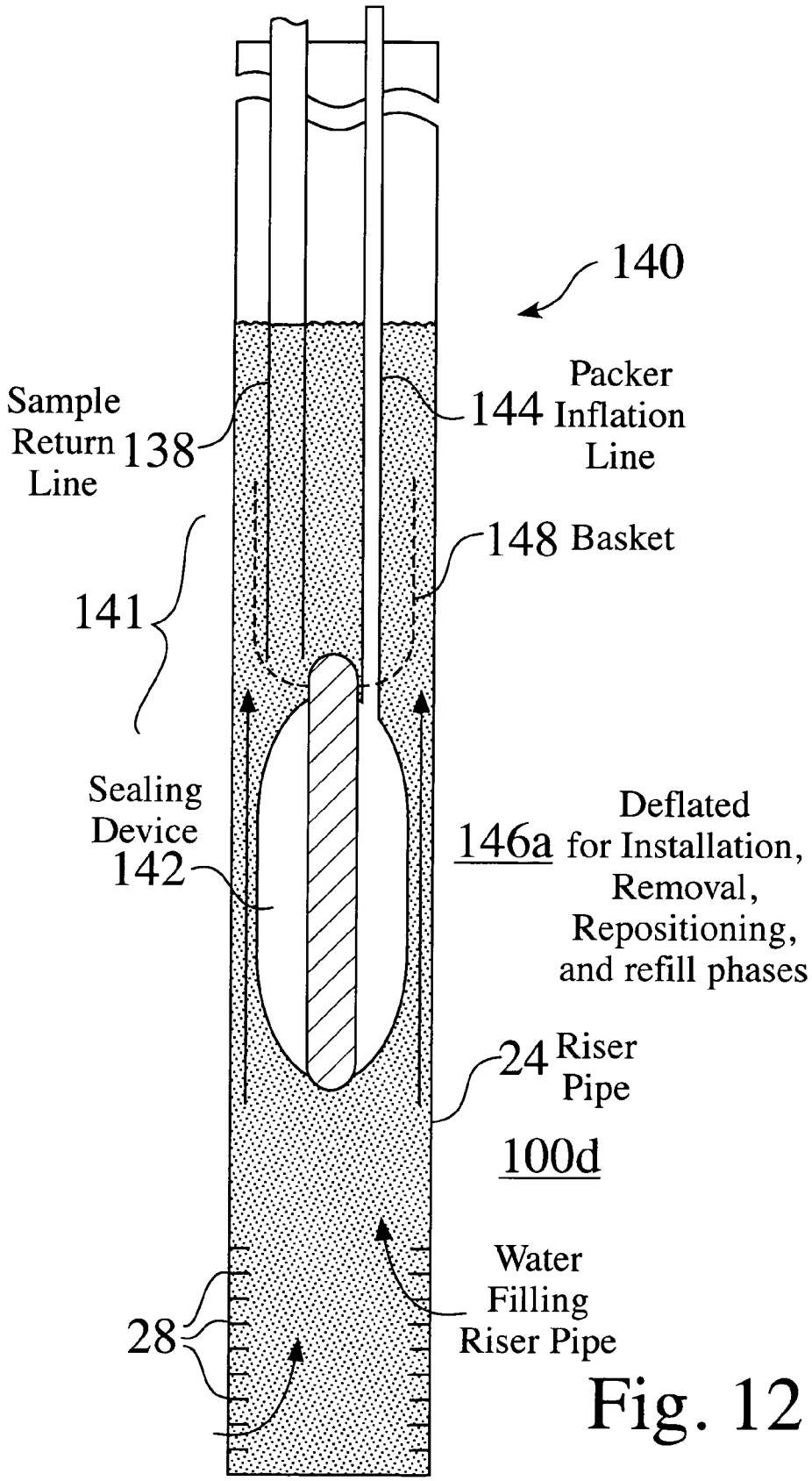
FIG. 12 shows a sampling system comprising a sampling structure which is fixedly located above an inflatable sealing device, in which the sealing device is in a deflated position.
Figure 13:
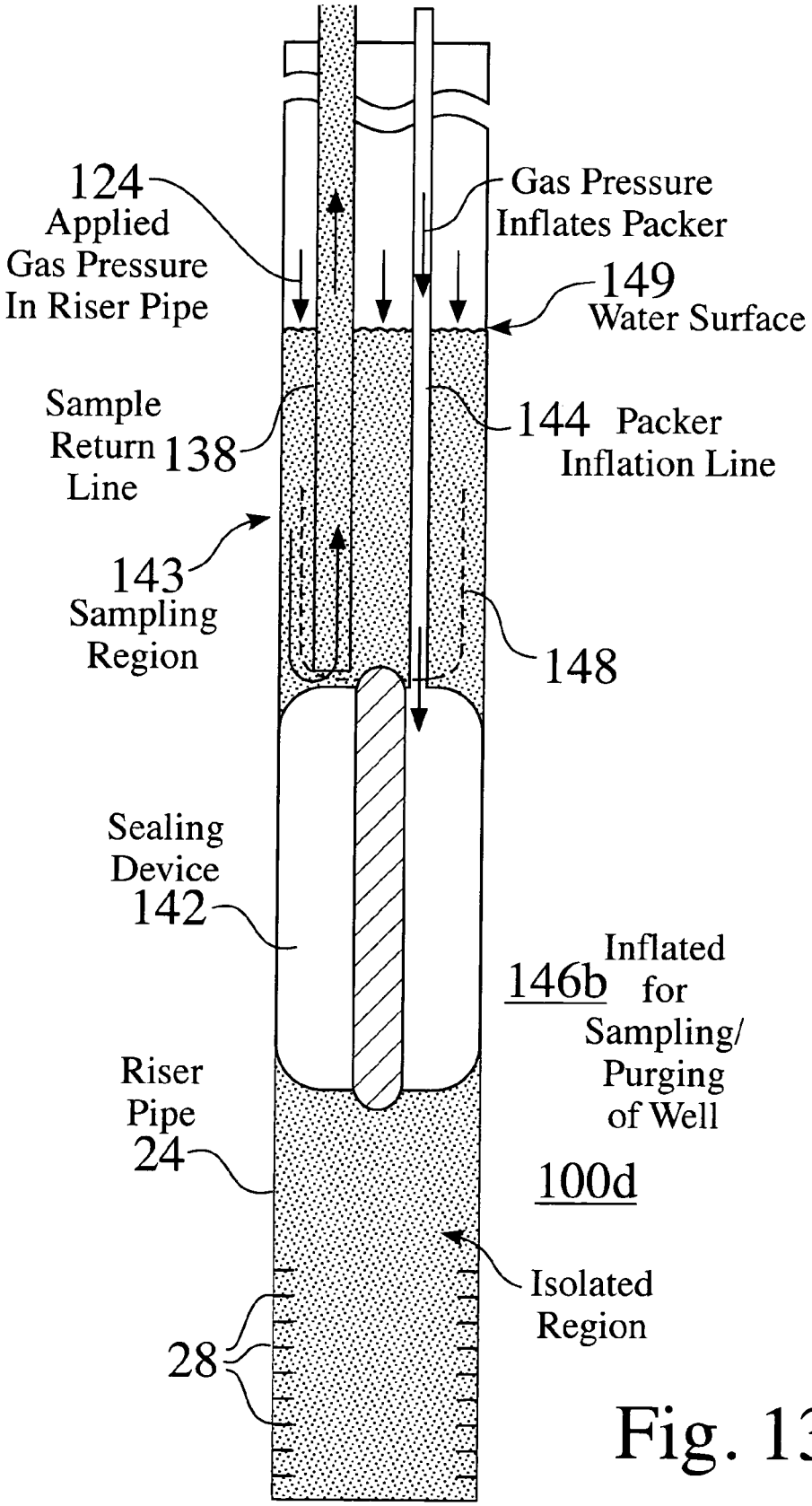
FIG. 13 is a schematic cutaway view of sampling system comprising a sampling is fixedly located above an inflatable sealing device, in which the sealing device is in an inflated sealed position.

FIG. 12 is a schematic cutaway view of a direct pressure pumping system 100*d* which provides direct pressure pneumatic pumping and sampling, comprising a sampling structure 141 which is fixedly located above an inflatable sealing device 142, such as a packer, which is placed above a primary filter/screen area 28 of a standard monitoring well 15, in which the sealing device 142 is in a deflated position 146*a*. FIG. 13 is a schematic cutaway view of a direct pressure pumping system 100*d* comprising a sampling structure 141, in which the sealing device 142 is in an inflated, i.e. sealed position 146*b*.

As seen in FIG. 12 and FIG. 13, a pneumatic balloon or packer 142 is inserted into a riser pipe 24, so that when the sealable device is inflated 146*b*, the walls of the riser 24 are sealed off from the screen/primary filter 28 of the well 15. A basket 148 is located above the sealing device 142 and typically around the inflation line 144, which keeps the end of the sample return line 138 from passing the packer 142 when it is deflated 142*a*. The packer 142 is inflated during a purge cycle 122, to prevent water FL in the riser pipe 24 from being forced back out the well screen 28 and into the surrounding formation FM. The packer 142 is deflated between purge cycles 122, to allow water FL from the formation FM to refill the riser pipe 24. During a purge cycle 122, the applied pressure through the inflation line 44 to the packer 142 is preferably greater than the applied pressure 124 introduced into the riser pipe 24, so that the packer seal is retained. The basket 148 is not required if the end of the sample return line 138 is affixed to the top of the packer 142, or to the side of the packer inflation line 144, such that the lower end of the sample return line 138 is affixed just above the top of the packer 142.

Figure 14:
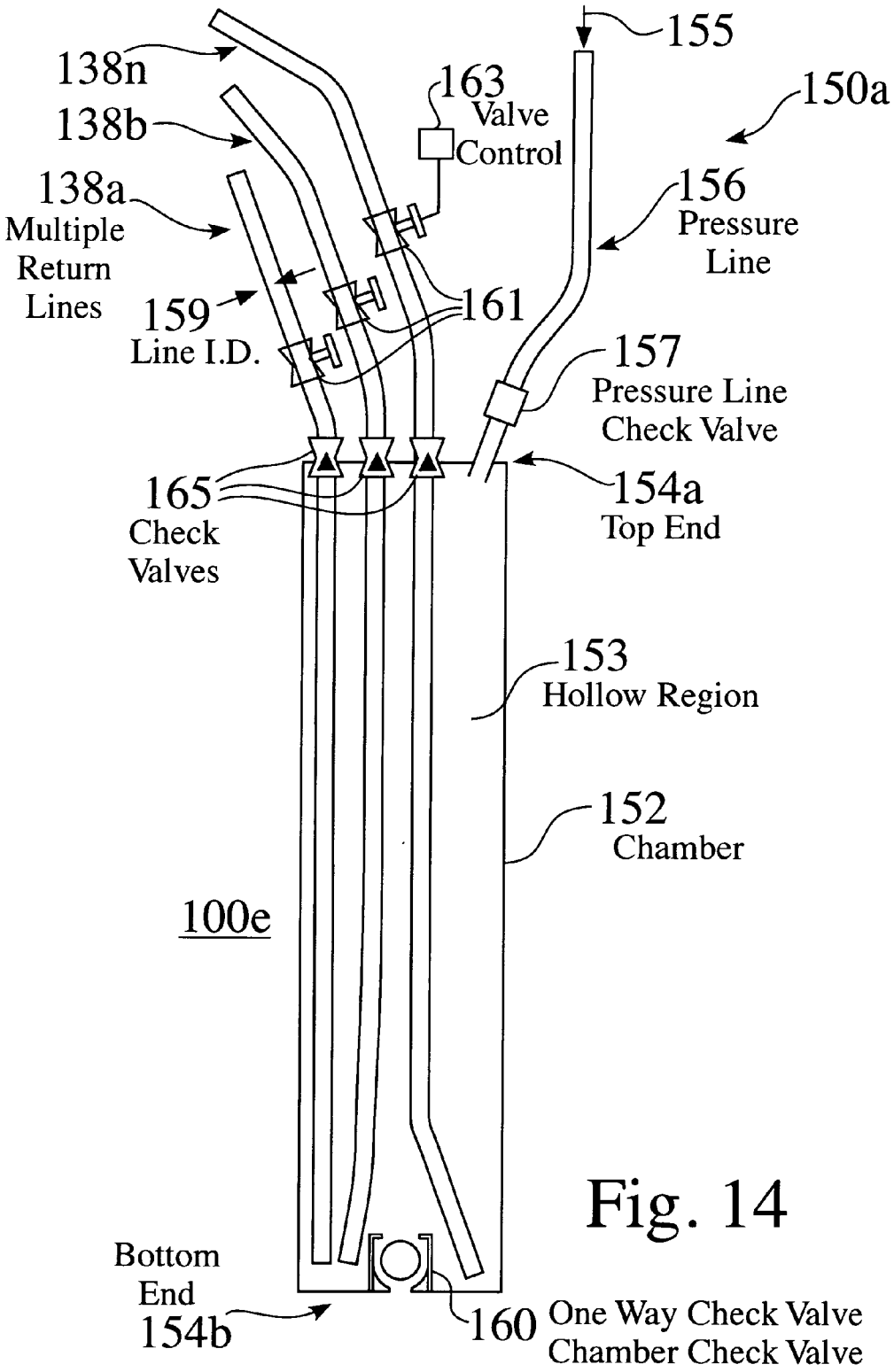
FIG. 14 is a schematic view of a multiple return line embodiment having a chamber.
Figure 15:
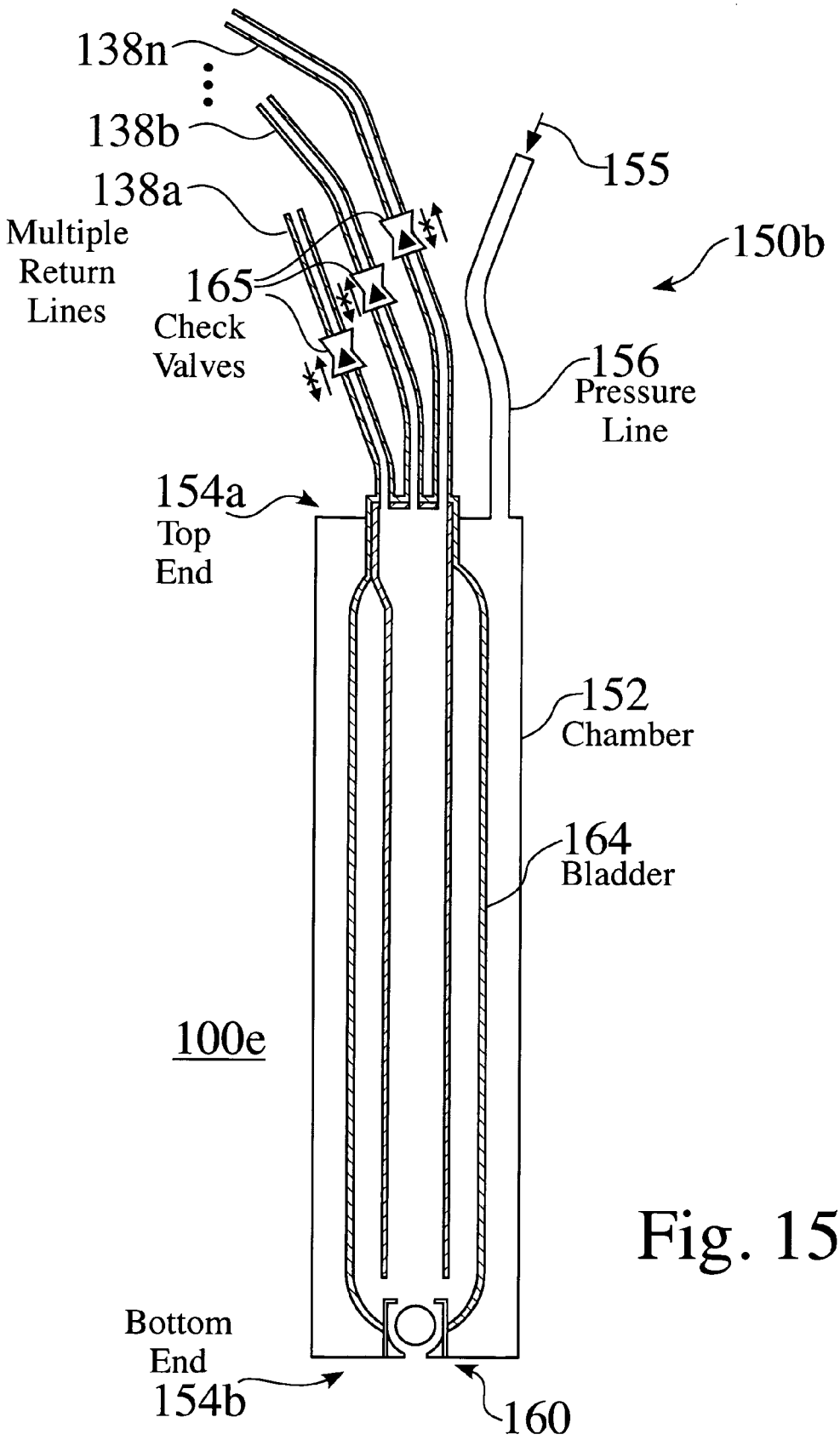
FIG. 15 is a schematic view of a multiple return line embodiment having a bladder.

Alternate Direct Pressurization Structures. FIG. 14 is a schematic view 150*a* of a direct pressurization pump 100*e* having multiple return lines 138*a*–138*n* within a chamber 132. FIG. 15 is a schematic view of a direct pressurization pump 150*b* having multiple return lines 138*a*–138*n* and an inflatable bladder 164 within a chamber 152.

The direct pressurization pump 100*e* shown in FIG. 14 comprises a hollow chamber 152 which is tillable with water or other fluids FL, a one-way chamber check valve 160, which allows fluid FL to enter the chamber 152 but prevents the fluid FL from flowing back out of the chamber thru the valve 160, a pressure line 156 which is used to introduce gas to the chamber, and a plurality of return lines 138*a*–138*n* through which the fluid FL flows out of the chamber 152 when the pump system 150*a* is activated. In some embodiments 150, the pressure line 156 includes a float-type check valve 157, which prevents fluids FL from flowing into the pressure line 156 when the line 156 is in the rest phase, e.g. during fill 170 (FIG. 16) or venting 190 (FIG. 18), of a pumping cycle. The fluid return lines 138*a*–138*n* typically enter the top 154*a* of the chamber 152 and end inside and at the bottom of the chamber 152. In alternate embodiments, the fluid return lines 138*a*–138*n* enter the chamber 152 at the bottom 154*b*. The bottom 154*b* of chamber 152 may also be configured so as to form a sealable connection with the seat 32 in FIG. 2.

While the exemplary valve 160 shown in FIG. 14 and FIG. 15 is described as a check valve, the valve 160 can alternately be any of a wide variety of valves such as but not limited to a ball and seat valve, a rubber "duck bill" or reed valve, a poppet valve, a flapper valve, or a needle valve, or can be connected to an external check valve below the chamber 152, such as the valve assembly 40 shown in FIG. 1. As well, the valve 160 can be a remotely actuated valve, such as but not limited to a pneumatically actuated valve, an electronically actuated valve, and/or a mechanically actuated valve 160.

As well, while the exemplary valve 160 is shown inside of chamber 152 in FIG. 14 and FIG. 15, it may also be configured to be outside of the chamber and may be configured to form a sealable connection with the seat 32 in FIG. 2.

The direct pressurization pump 100*e* shown in FIG. 15 further comprises an inflatable bladder 164 or piston 164 associated the gas pressure 155 applied to the chamber 152, whereby gas 155 used to purge and sample the system 150*b* is isolated from contact with the well's water FL.

In the direct pressurization pump 100*e* shown in FIG. 15, the fluid return lines 138*a*–138*n* typically include check valves 165 (FIG. 14), which prevents fluids FL that have entered the fluid return lines 138*a*–138*n* during a purge and/or sample phase 180 (FIG. 17) from flowing back into the chamber 156, such as during repeated sampling. For example, as an inflatable bladder 164 or piston 164 is repeatedly inflated to sample or purge 180, and deflated to allow more fluid FL to enter, i.e. fill 150 (FIG. 16) the chamber 156 through the valve 160, the overall sampling and/or purging 180 comprises a "ratcheting" of sample volumes which enter and travel through the fluid return lines 138*a*–138*n*.

The limit to the pumping rate of single return line pneumatic pumps can be reduced i.e. limited, by friction loss through the narrow internal diameter line used on the system. While a fluid return line 138 having a larger diameter 159 can be used to reduce friction losses, there can be disadvantages, such as a requirement of increased line wall thickness to hold high pressures, and the difficulty in continuing to lift water in the line, once the chamber 152 is empty and gas enters the lower end of the sample return line 138.

The direct pressurization device 100*e* therefore preferably comprises a plurality of return lines 138*a*–138*n*, which provides a pneumatically powered pump that have significantly higher flow rates than is possible with a pump using a single return line, especially when used in deep boreholes or deep wells 15.

System Operation for Direct Pressurization Structures. The direct pressurization structures 100*e* are readily implemented for several operations within a well or piezometer.

Figure 16:
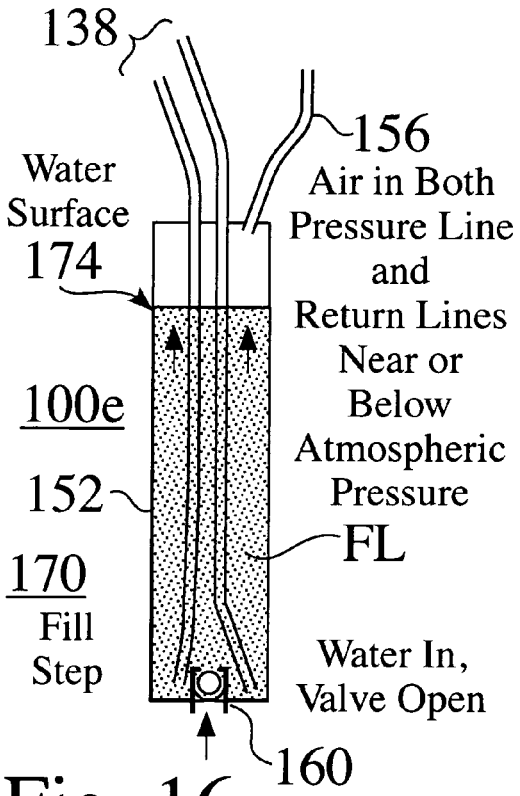
FIG. 16 is a schematic view of a fill step.
Figure 17:
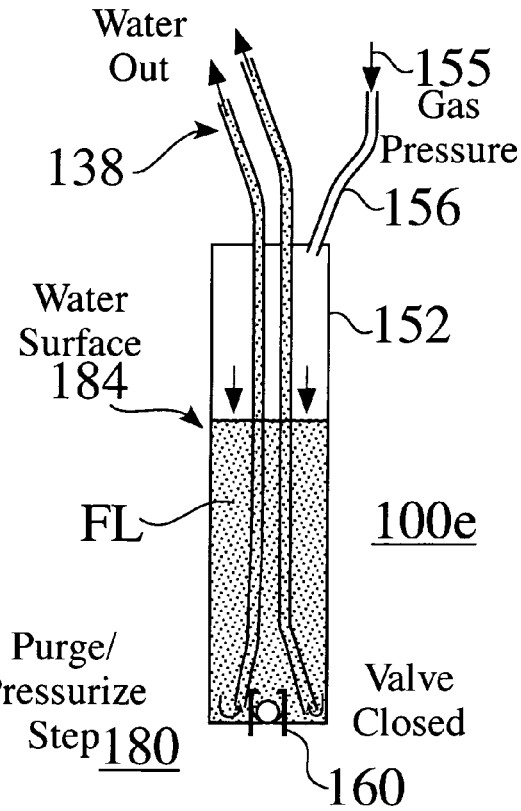
FIG. 17 is a schematic view of a pressurize step.
Figure 18:
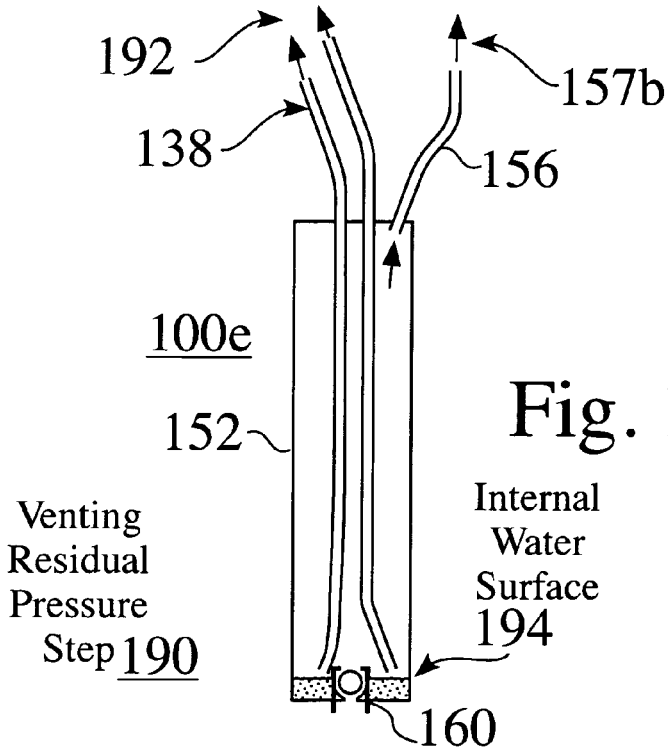
FIG. 18 is a schematic view of a venting of residual pressure step.

FIG. 16 is a schematic view of a fill step 170. FIG. 17 is a schematic view of a pressurize/pumping step 180. FIG. 18 is a schematic view of a venting of residual pressure step 190, in which the valve 160 remains closed until the residual gas pressure 155 falls below the pressure of external fluid FL, at which point the fill step 170 (FIG. 16) begins again.

When used in a well 15, the pump system 100*e* is operated by lowering the chamber 152 into the well 15 until it is submerged in the water FL, so that the chamber 152 fills with water through the chamber check valve 160. Gas pressure 155 is then introduced into the chamber 152 via the pressure line 156. This pressure 155 closes the chamber check valve 160, and the water FL is forced to the surface GS through the return lines 138*a*–138*n*. When the system 100*e* is drained of water FL, the gas pressure 155 is shut off, and both the return lines 138*a*–138*n* and the pressure line 156 are allowed to vent residual pressure to the atmosphere. This allows the system 100*e* to refill with water FL in preparation for the next pumping cycle 180.

The use of multiple return lines 138*a*–138*n* is readily used for other direct pressure pneumatic pumping systems 100, 400,500, such as either hanging in a monitoring well or buried directly in a borehole.

With multiple return lines 138, pneumatic purge pump and/or bladder pump flow rates can be substantially increased without increasing the ID 159 of the return line 138. When used in wells and other applications where water FL is very deep, direct pressure pneumatic pumping systems 100*e* having multiple return lines 138 can pump a specific volume of water in substantially less time than that of a system having a single return line 138. The use of multiple return lines 138 on a pneumatic pump 100*e* is therefore advantageous, especially when used to pump water FL from very deep wells 15 where the piezometric surface of the water is also deep.

The use of multiple return lines 138 may also be applied to sample return lines on bladder pumps or any other system where the gas pressure does not directly contact the water in the sample return lines, and can also be applied to electrically or mechanically powered submersible pumps.

As seen in FIG. 14, the direct pressurization system 100*e* may further comprise flow control valves and/or check valves 161 located in the respective fluid return lines 138. The valves 161 can be closed to block one or more lines 138, such as at the end of a purge cycle 180 (FIG. 17), to prevent pneumatic pressure 155 from being diverted away from one or more other lines 138 that are still delivering water FL to the surface GS.

The valves 161 can preferably be controlled 163, such as to detect the flow of air 155 in the line 138 at the end of a purge cycle 180, whereby upon detection, the valve 161 closes to blocks the line 138, which prevents pneumatic pressure 155 from being diverted away from one or more other lines 138 that are still delivering water FL to the surface GS.

Without such valve control 163, it is possible that enough gas pressure 155 can be diverted to an empty line 138, such that that the weight of water FL in the other line or lines 138, which are still being purged, could slow or stop the discharge from these other lines 138.

As well, the preferred use of valve control 163 can reduce the quantity of gas 155 used in operating the system 100*e*. In a basic control embodiment 163, a technician can close a valve 161 on a line 138 as air is observed exiting a line 138. In alternate control embodiments 143, the control 163 comprises mechanical and/or electronic detectors which automatically actuate one or more valves 161 to close off one or more respective lines 138, after detecting air in the respective lines 138. While the valves 161 and controls 163 can be located anywhere on the lines 138, the valves 161 and controls 163 would typically be located at or near the ground surface GS and/or discharge end of the lines 138.

Figure 31:
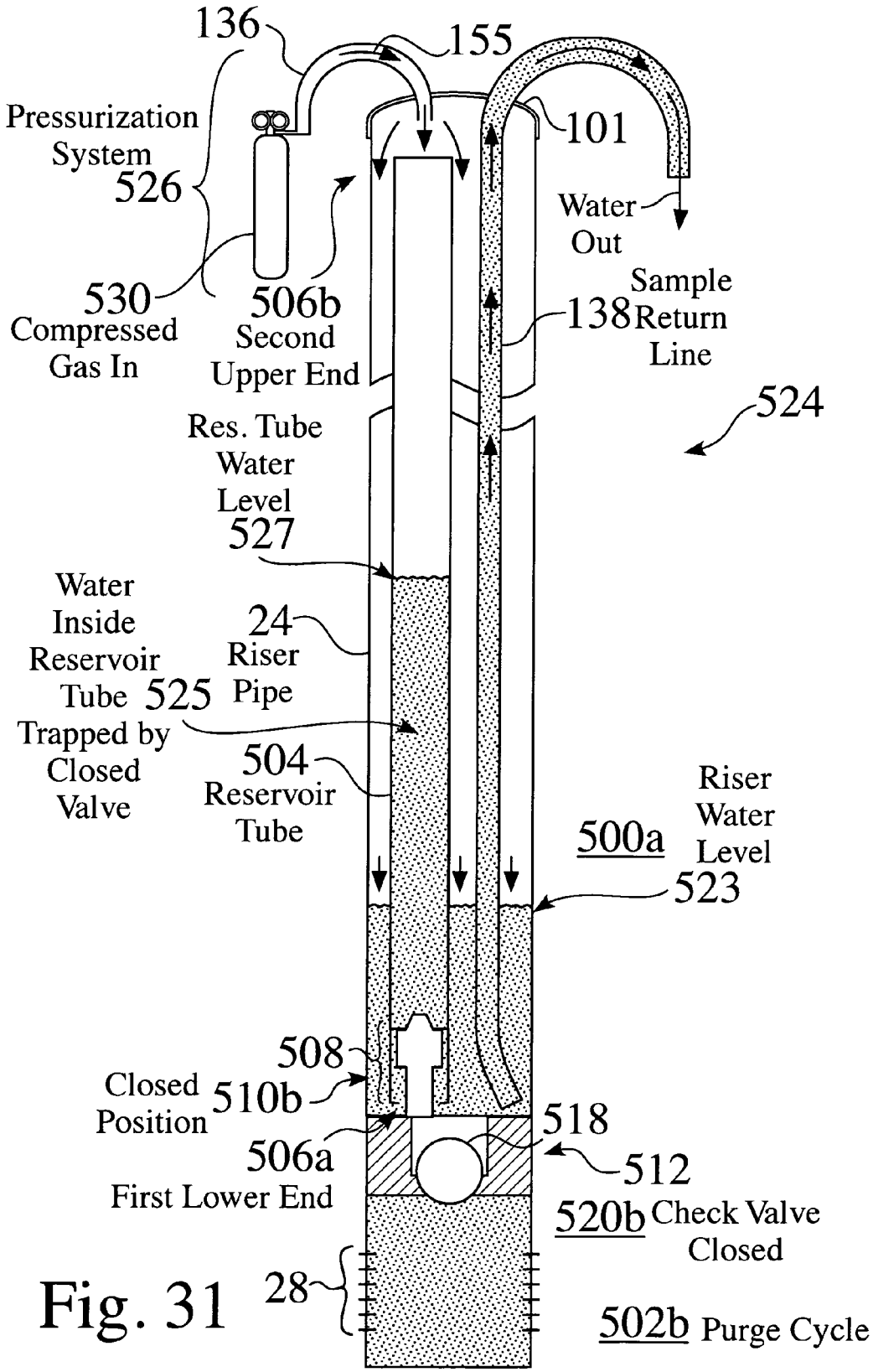
FIG. 31 is a schematic cutaway view of a sampling tube and valve device in a second closed position.

The direct pneumatic pressure pumping method provides a one-way check valve above the screened interval of a well, typically a narrow diameter well, so that the blank casing of the well becomes the outer housing of the pneumatic pump. This structure may also be used as a pump placed inside of an existing well. A sample return line 138 typically comprises a flexible tube, such as plastic, nylon, floropolymer, e.g. Teflon™, or similar material, and is placed so that it extends from above the ground surface GS, down the riser pipe 24, and ends near the top of the valve 512 (FIG. 31). The top of the well 15 is sealed with a cap 101 (FIG. 31). The sample return line 138 passes through an airtight seal in the cap 101. The cap 101 also has a fitting to allow compressed gas 155 to be introduced into the headspace above the water in the riser pipe 24. As the gas 155 pushes down on the water surface, the valve 512 closes, blocking the water from being pushed out through the well screen. Since the top of the sample return line 138 is open to the air, the gas pressure 155 pushes the water up and out the end of the sample return line 138.

Figure 19:
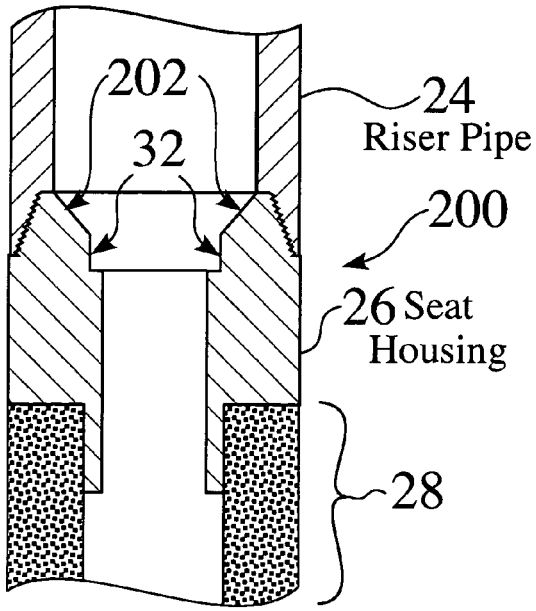
FIG. 19 is a detailed cutaway view of a riser pipe, u-cup seat, and screen/primary filter.

FIG. 19 is a detailed cutaway view of well structure 200 comprising a riser pipe 24, a housing 26 having a u-cup seat 32, and a screen/primary filter 28. As seen in FIG. 19, the seat housing 26 also includes a ledge 202, which can be used as a resting surface 202 for a support structure 222 (FIG. 21) for a sample return line 138.

Figure 20:
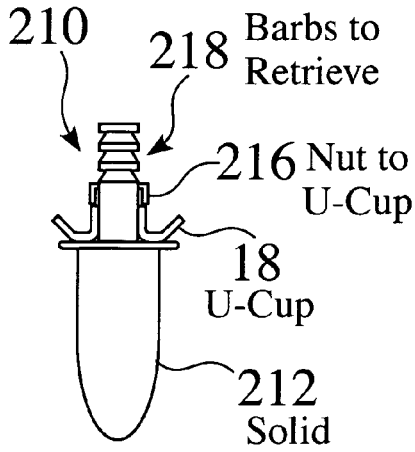
FIG. 20 is a side schematic view of a solid plug/guide which is attachable to a retrieval tool.

FIG. 20 is a side schematic view of a solid plug/guide 210 which is attachable to a retrieval tool, and which is adapted to be installed within a well structure 200. The exemplary plug guide 210 comprises a solid plug/guide structure 212 which is adapted to be installed within the seat housing 26 of the well structure 200. The plug guide 210 also comprises a seal 18, such a U-cup seal 18, which forms a sealable connection to the seat 32 within the housing 26. The seal 18 is typically retained 216, such as by a nut 216. The plug guide 210 also typically includes means for retrieval 218, such as but not limited to a barbed end 218.

Figure 21:
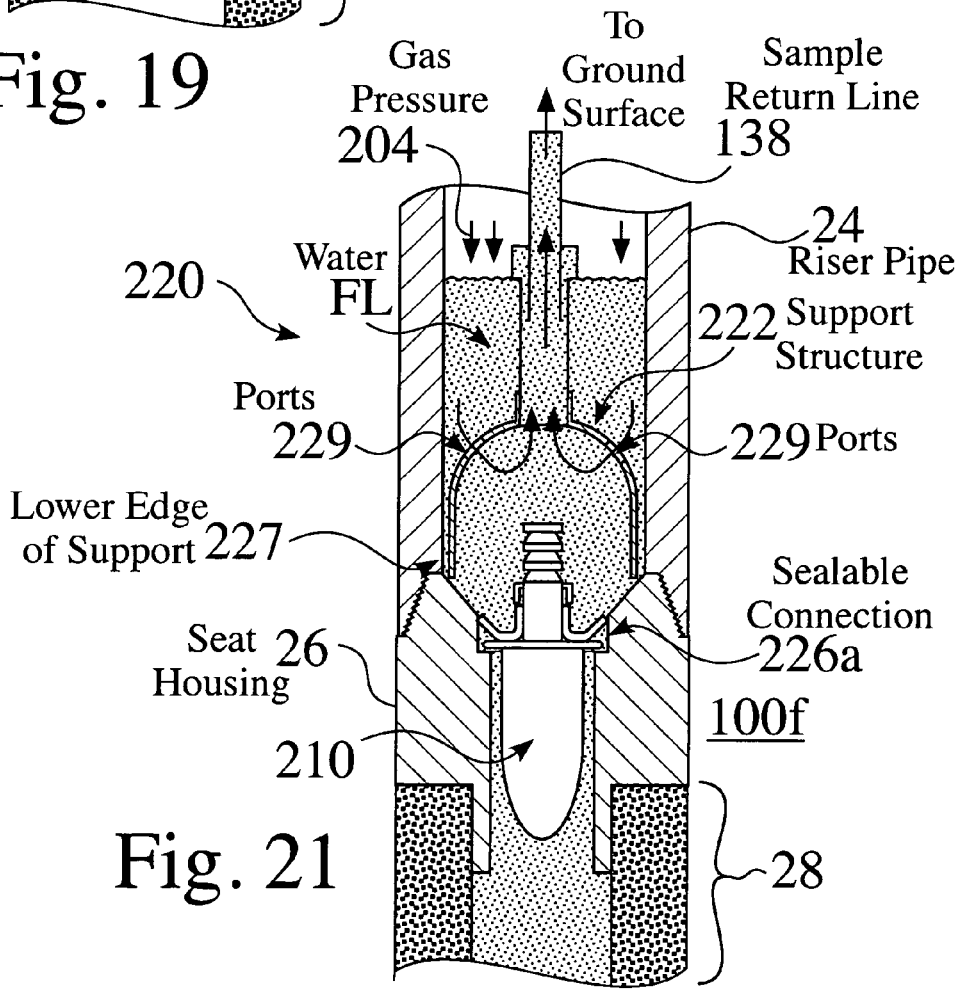
FIG. 21 is a schematic view of a purge/sample cycle for a solid plug/guide within a u-cup seat.
Figure 22:
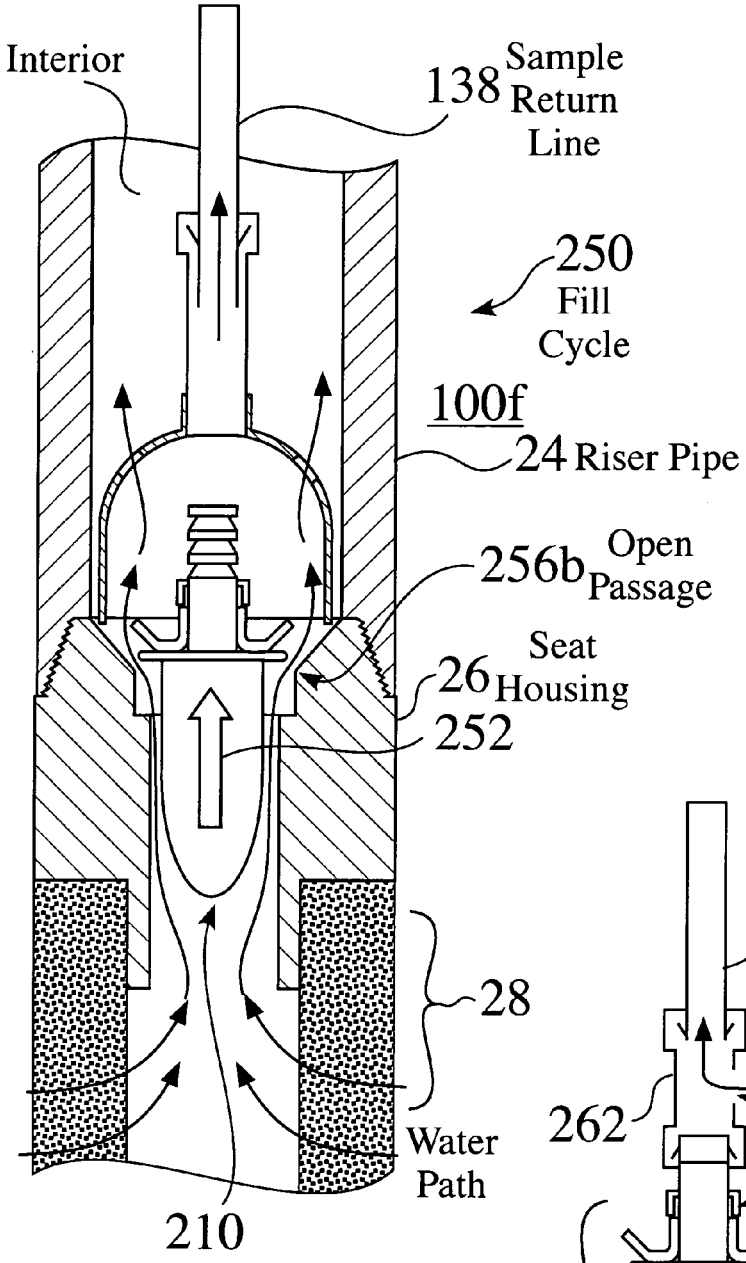
FIG. 22 is a schematic view of a fill cycle for a solid plug/guide within a u-cup seat.

FIG. 21 is a schematic view of a purge/sample cycle 220 within a well structure 180. FIG. 22 is a schematic view of a fill cycle 250 within a well structure 200. FIG. 21 and FIG. 22 also show assembly details regarding the assembly and movement of the plug guide 210 and support structure 222 within the well 200.

As seen in FIG. 21, upon direct, i.e. pneumatic, pressurization 224, the u-cup seal 18 rests on the seat 32, to form a sealed connection 226*a*. As seen in FIG. 22, without direct pressurization 224, the u-cup seal 18 floats on the seat 32, to form a open passage 226*b*, which allows water FL to refill the riser pipe 24, by flowing between the u-cup seal 18 and seat 32. In the exemplary housing embodiment 26 shown in FIG. 21 and FIG. 22, the seat housing 26 does not include a central valve or a groove in the seat 32 to hold the u-cup 18 onto the seat 32.

The sample return line shown in FIG. 21 and FIG. 22 includes a support structure 222 attached to its lower end 227, which is designed such that the lower edge 227 preferably rests on the ledge constriction 202 above the seat 32, and allows the solid plug/guide 210 to move up 252 (FIG. 22) enough to allow water FL to flow up around the u-cup seal 18. The plug guide 210 is preferably comprised of lightweight materials, so as not to impede the flow of water FL up from the screen/primary filter 28.

Figure 23:
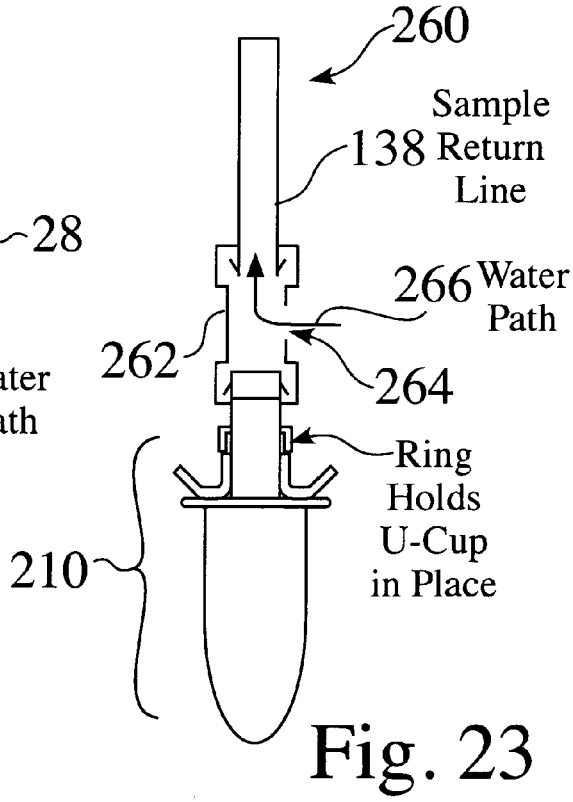
FIG. 23 shows a sample return line is attached to the top of a u-cup seal stem, in which the end of the return line is open on one side, and is located above the top of the u-cup seal.

In an alternate embodiment shown in FIG. 23, the sample return line 138 is attached to the top of the u-cup seal stem 262, in which the end of the return line is open 244 on one side, and is located above the top of the u-cup seal 18. In the embodiment shown in FIG. 23, the seal 18 is controllably openable by the operator USR, who can pull up on the sample return line 138 at the end of each purge cycle 220 (FIG. 21).

Figure 24:
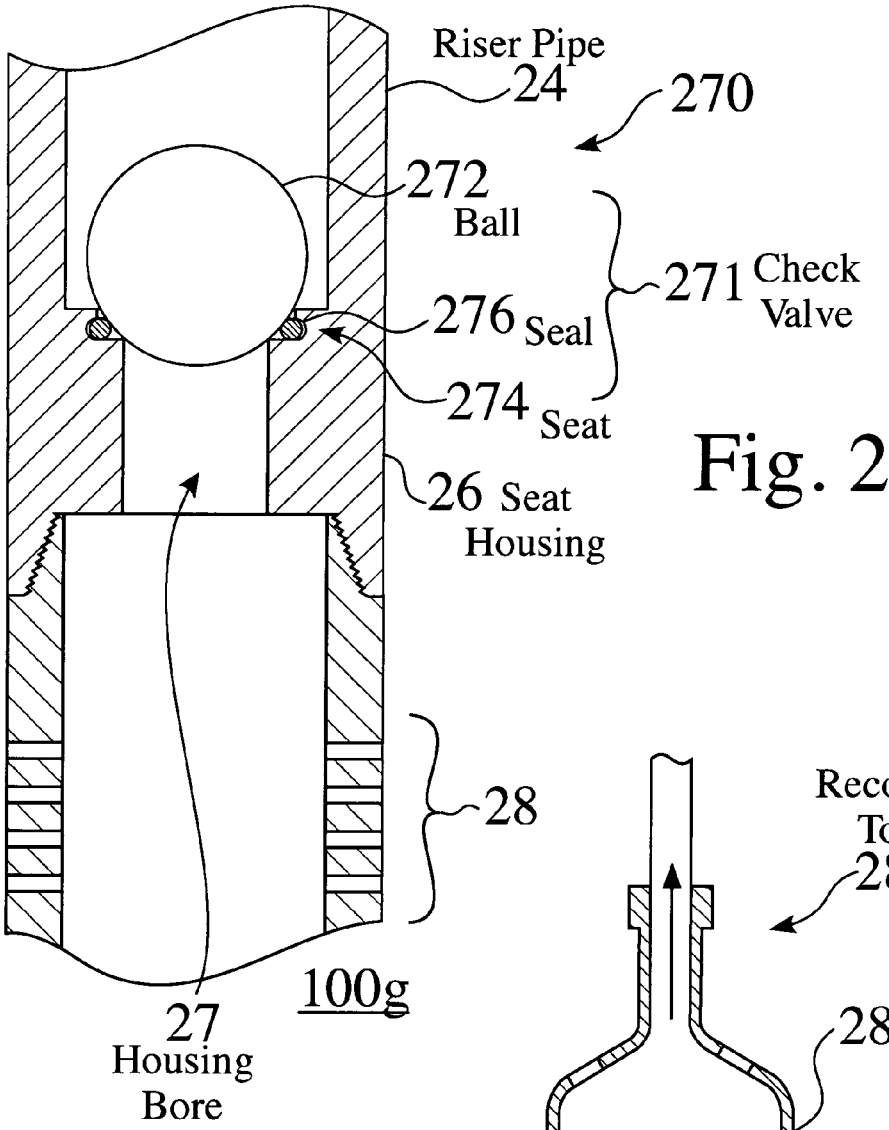
FIG. 24 is a schematic cutaway view of a ball type check valve, comprising a ball located on a seat within a housing bore defined through a seat housing.
Figure 25:
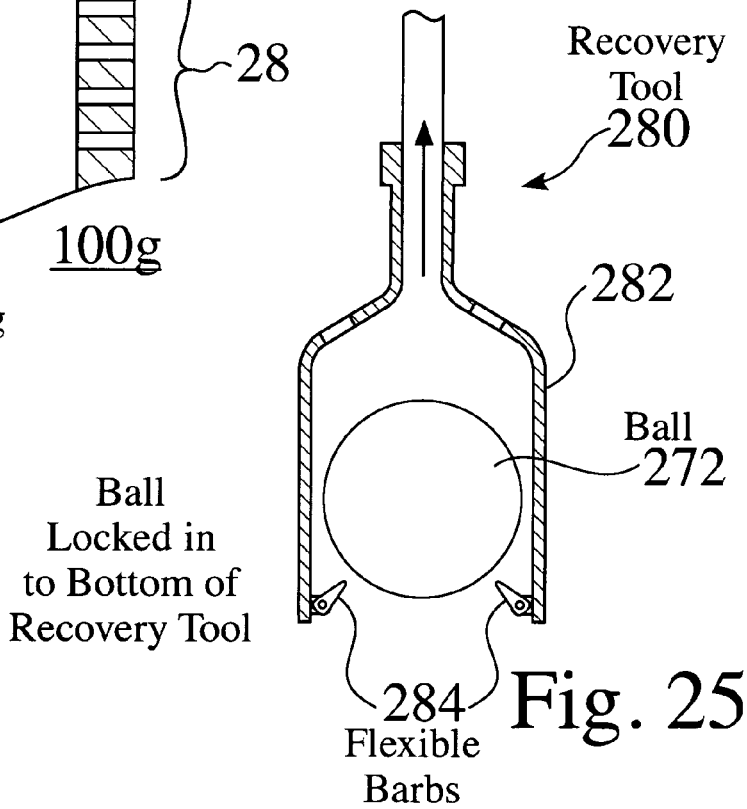
FIG. 25 is a schematic cutaway view of a recovery tool for a ball.
Figure 26:
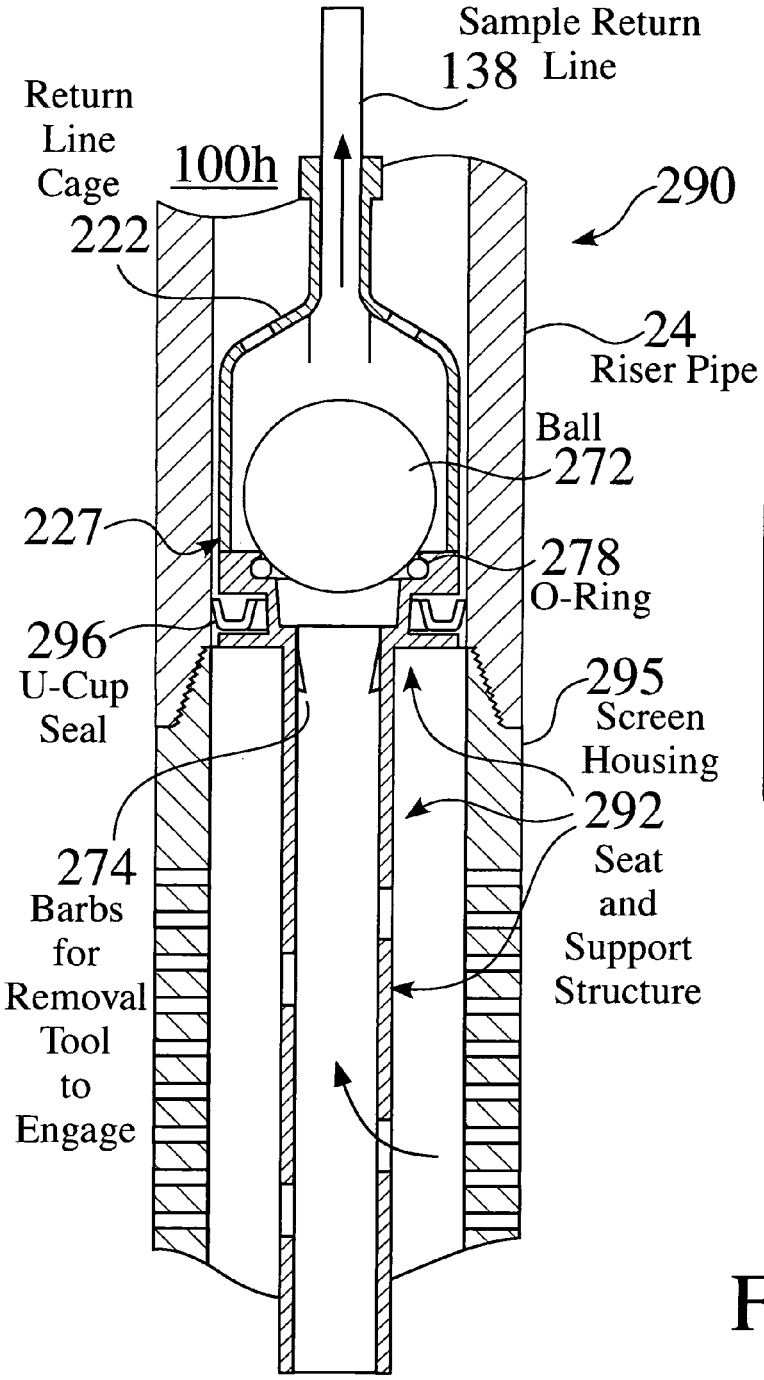
FIG. 26 is a schematic cutaway view of an integrated ball type check valve, comprising a ball located on a seat and support structure within a riser pipe.

FIG. 24 is a schematic cutaway view of a ball type check valve 271, comprising a ball 272 located on a seat 274 located at a housing bore 27 defined through a seat housing 26. FIG. 25 is a schematic cutaway view of a recovery tool 280 for a ball 272. FIG. 26 is a schematic cutaway view of an integrated ball type check valve 290, comprising a ball 272 located on a seat and support structure 292 located within a riser pipe 24.

In the ball type check valve 271 shown in FIG. 24, the seat 274 typically includes a seal 276, such as an o-ring seal 276. In some valve embodiments 271, to provide a ball type check valve 271, the ball 272 is dropped into the riser pipe 24 and seats on a constriction 274,276 designed into the bottom of the well's riser pipe 24, or alternately on a seat 294 placed, with a supporting structure, into an existing well 15, as seen in FIG. 26.

As seen in FIG. 25, the ball 272 is removable with a tool 280 designed to slip over the ball 272 and hold the ball 272 by retaining means 282, such as by friction, or by flexible barbs. Retaining means may alternately comprise magnetic attachment, or electromagnet attachment 282, for balls 272 which at least partially comprise iron or other materials attracted to magnets.

As seen in FIG. 24, a formable seal can be formed between a hard ball 272 and an o-ring 276 or similar soft sealing material in the seat 274, or alternately by a soft covering over the ball 272 and a smooth, hard seat 274.

As seen in FIG. 26, the return line 138 comprises a cage 222 attached to its lower end, wherein the lower edge 227 of the cage 222 rests on the support structure 292, while the ball 272 is free to move within the cage structure 222. The support structure 292 typically includes a seal 296, such as a U-Cup seal 296, between the support structure 292 and the riser pipe or well screen housing 295.

Figure 27:
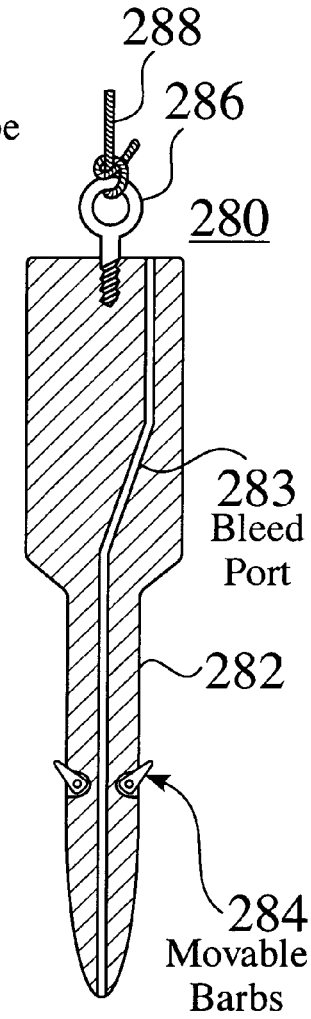
FIG. 27 shows a retrieval tool for removing a valve seat and support structure.

FIG. 27 shows a retrieval tool 280 for removing a valve seat and support structure 292. For a support structure 292 which is to be used in an existing well, it is typically preferable that the seat support structure 292 is removable. The retrieval tool 280 shown in FIG. 27 comprises a body 282, means for attachment 284 to the support structure 292, such as but not limited to movable barbs 284, and means for tool placement and removal, such as an eyelet 286 and cord 288. The retrieval tool 280 shown in FIG. 27 also preferably comprises a bleed/vent port 283 defined through the body 282, to allow fluid FL to pass through the body while the tool 280 is moved through the well structure.

While several of the exemplary direct pressurization systems 100 are described herein as using valves or plugs, other seals may readily be used. As well, during a removal operation, the entire valve does not need to be removed. For example, a single component ball 272 of the valve 271 (FIG. 24) can be removed, while leaving the matching valve components 276 in the well and the well open from the riser pipe 24 to the screen/primary filter 28.

Therefore, in some embodiments of the direct pressurization systems 100, the entire valve is removed, while leaving other components of the pump in place, e.g. the riser pipe 24. In alternate embodiments of the direct pressurization system 100, the entire valve is not required to be removed, such as for embodiments 100 wherein only a portion, e.g. a single component, of the valve, is removed, which provides similar functionality.

Figure 28:
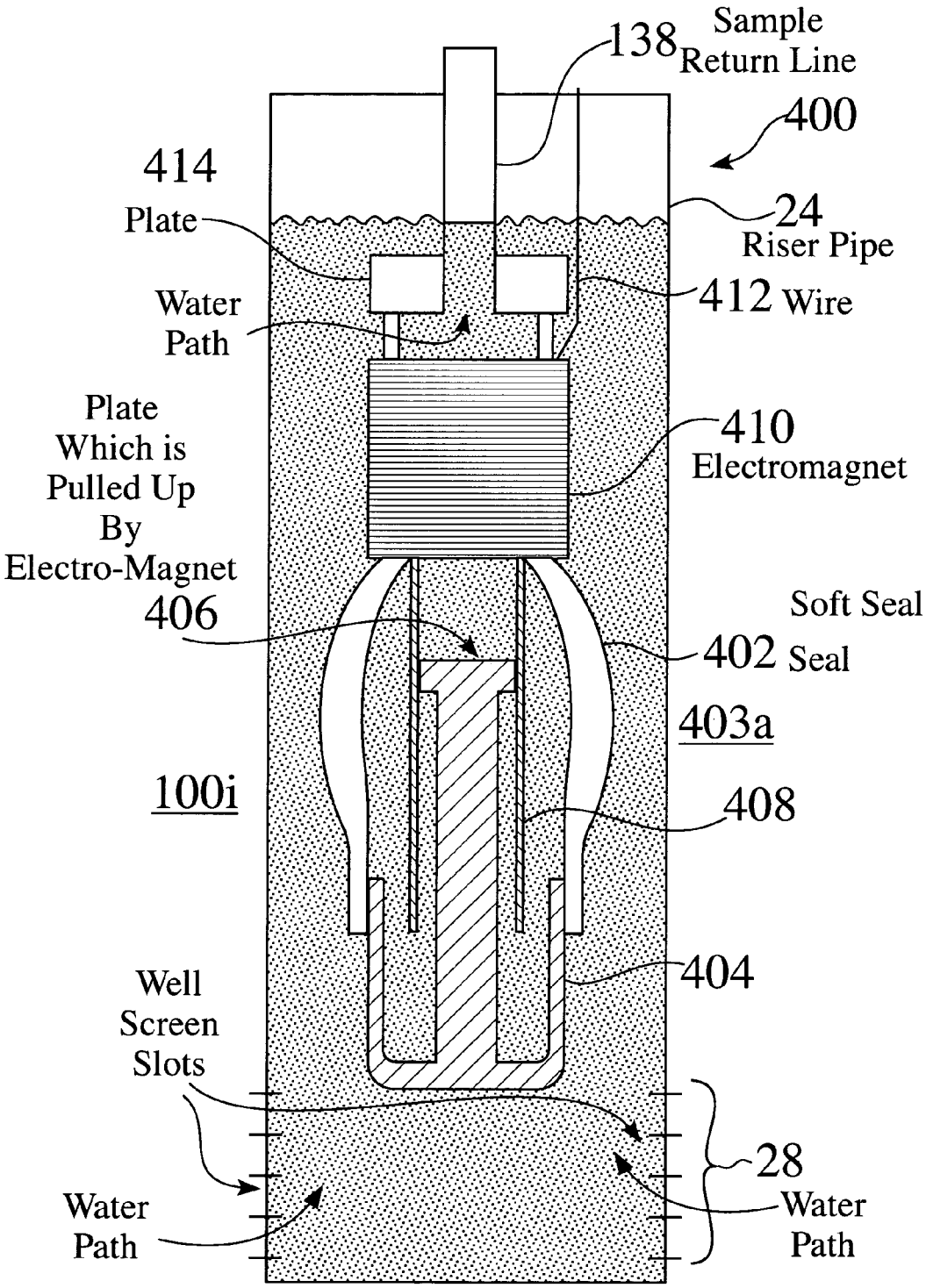
FIG. 28 is a schematic cutaway view of a direct pressurization system for purging and/or sampling comprising an electromagnetic seal, in which the seal is in an open position.
Figure 29:
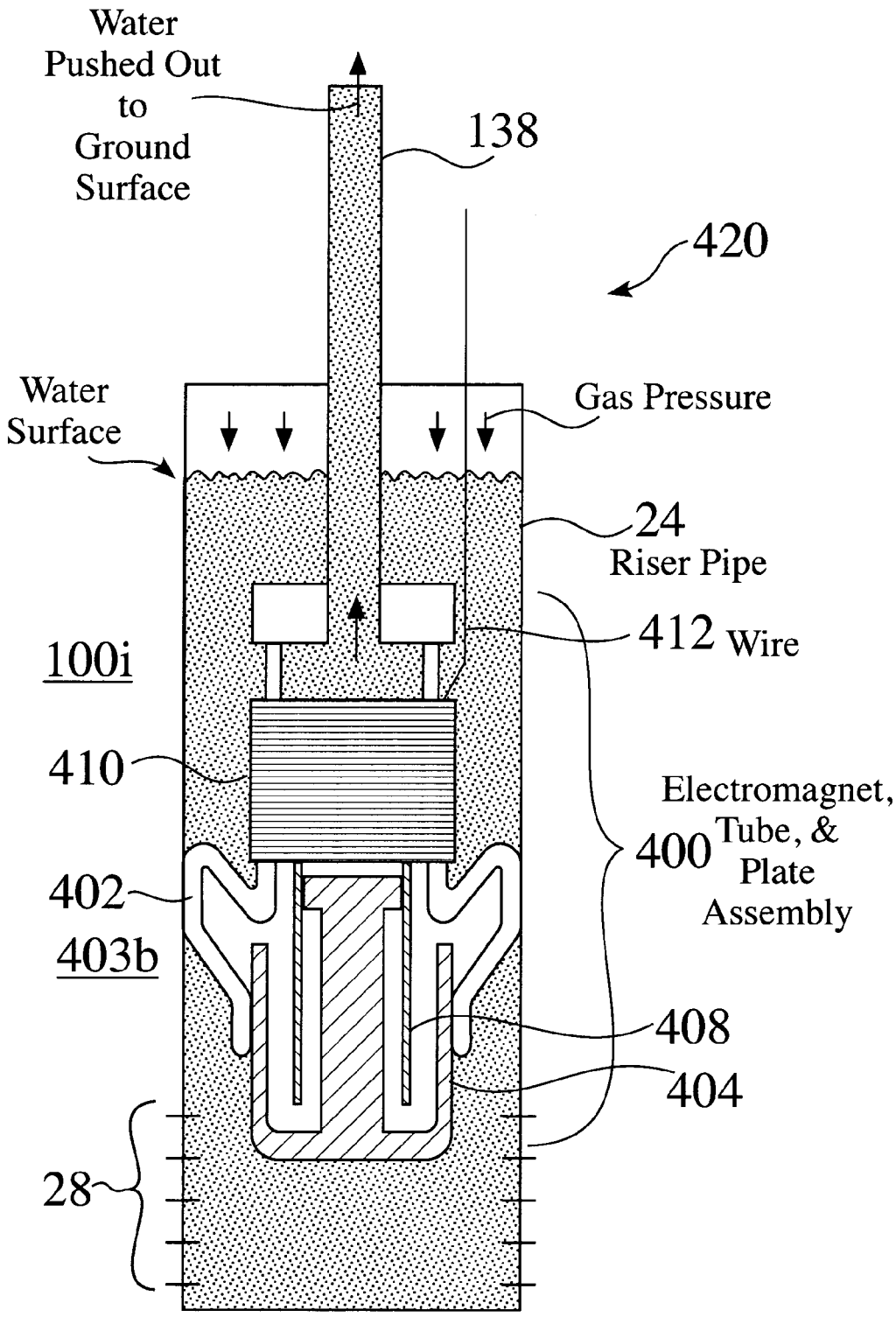
FIG. 29 is a schematic cutaway view of a direct pressurization system for purging and/or sampling comprising an electromagnetic seal, in which the seal is in a sealed position.

FIG. 28 is a schematic cutaway view 400 of a direct pressurization system 100*i* for purging and/or sampling comprising an electromagnetic seal 402, in which the seal is in an open position 403*a*. FIG. 29 is a schematic cutaway view of a direct pressurization system 100*i* for purging and/or sampling comprising an electromagnetic seal 402, in which the seal is in a closed, i.e. sealed, position 403*b*.

Activation of the electromagnet 410 causes controlled movement of the lower body 404, having a plate 406, in which the lower body 404 is fixedly attached to one end of a flexible seal 402, such as a rubber tube seal 402. As seen in FIG. 27, upon activation of the electromagnet 410, such as through a wire 410, the flexible seal 402 is squeezed against the walls of the riser pipe 24, thereby sealing the screen/primary filter 28 off from the riser pipe 24. When an operator USR deactivates the assembly 100*i*, e.g. by reversing a switch position for wire 410, the system 100*i* relaxes, allowing the tube 402 to move away from the wall of the riser pipe 24, allowing water FL to refill the riser pipe 24, as seen in FIG. 28.

The direct pressurization system 100*i* can readily be configured such that either the opening or the closing of the seal 402 is done by energizing the electromagnets 410. A basket or plate 414 located just above the seal apparatus 400 keeps the end of the sample return line 138 from passing the seal 402 when the seal 402 in a relaxed position 403*a*. The seal assembly 400 can alternately be configured using a piston, actuated by either pneumatic pressure or by pulling a vacuum on the piston's chamber, depending on the configuration of the parts. This piston 410 takes the place of the electromagnet 410, tube and plate assembly 414 in FIG. 28 and FIG. 29. The piston is actuated using a tube from the ground surface GS in place of the wire 412 in FIG. 28 and FIG. 29.

System Advantages. Direct pressure pneumatic purge and sample pump systems 100 have the inherent advantages of producing little purge water requiring disposal, being relatively low cost to install and to operate, and being simple to operate with a minimum of training and equipment. Since the disclosed valves are easily replaceable, if a valve fails, users USR can be confident in placing direct pneumatic pressure pumping systems 100 directly in boreholes without the use of a standard well casing, knowing that a failed valve does not require abandoning the sampling point and/or redrilling the boring.

Since valves can be withdrawn and returned easily, the system can be used for a wide variety of applications, such as for systems having fixed valves which are impossible or at least impractical to use, such as, but not limited to, falling head slug tests, pump draw down tests, and other aquifer tests which are difficult or impossible to perform in systems having fixed valves.

Direct pressure pneumatic purge and sample pump systems 100 are readily adaptable to provide surging and/or jetting of the well's screen or primary filter element 28, which allows the clearing of sediment loading on the screen or primary filter element 28, thus reducing the chance of requiring an expensive replacement borehole, and allowing for a greater variety of filter and filter pack combinations than are practical with fixed valve systems.

As well, since valves can be withdrawn and returned easily, diffusion sampler bag methods of sampling can be used once the valve is removed. Furthermore, Instruments such as devices that analyze water parameters, water level changes and analyte concentrations could be suspended in the screened interval once the valve is removed.

Within various embodiments of direct pressure pneumatic purge and sample pump systems 100, seals 112,402 can be provided by a variety of sealing structures, such as but not limited to packers or similar pneumatic inflated seals, magnetic, electromagnetic seals, electro-magnetically actuated seals, o-ring seals, cable suspension actuated sealing systems, cable suspension systems which use the pneumatic pressure, and drop weight actuated sealing systems.

As well, a wide variety of recovery tools and engagement devices can be used to place, position, and/or remove all or part of the systems, such as but not limited to magnetic engagement tools, electromagnetic tools, bearing snap locks, e.g. such as used on some socket wrench ratchets to lock on the sockets, hooks, and loops, Velcro, screw on devices, and/or cam lock devices.

In addition, a wide variety of one-way valves can be used for functionality within the systems 100, such as but not limited to ball and seat valves, rubber "duck bill" valves, reed valves, poppet valves, flapper valves, and/or needle valves. As needed, the valves may also be remotely actuated by a variety of methods, such as but not limited to electronic actuation, mechanical actuation, and/or pneumatic actuation.

This method and apparatus allows existing narrow diameter wells, particularly those placed by direct push methods, to be purged and sampled by the highly effective direct pneumatic pressure method, instead of bailers.

This method and apparatus 100 also allows for the use of standard well screens 28, rather the fine filters typically used with fixed valve systems. For example, a well 15 can first be developed by swab and bailer, to remove fines, before a one-way valve is placed. Thereafter, the one-way valve 40, 100 e.g. any or all components of valve 100*b* (FIG. 7), can easily be serviced, such as if jammed by a stray sand particle.

Method and Apparatus for Reducing the Purge Volume of a Well. The following systems 500 provide a structures and methodology for reducing the volume of water FL purged from a well 15 during purging and sampling operations, such as for a direct purge pneumatic pump well 15, where a pressure vessel 505 is formed between the riser pipe 24, a head cap 528, and a closed check valve 512, and wherein a pressure line 136 provides access for pressurization 135 and venting.

Figure 30:
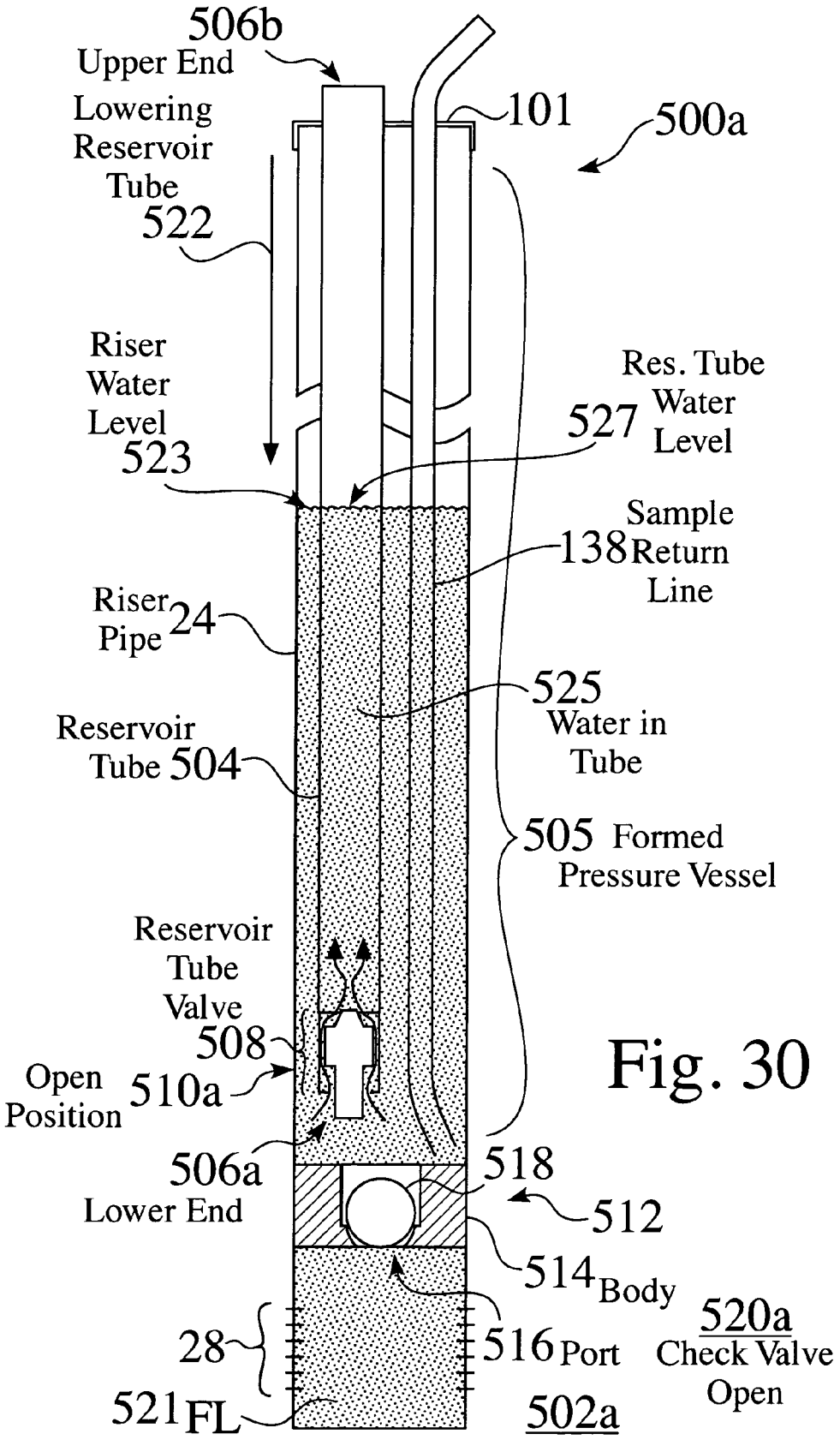
FIG. 30 is a schematic cutaway view of a sampling tube and valve device in a first sampling position.

FIG. 30 is a schematic cutaway view of a purge volume reduction system 500*a* in a first sampling position 502*a*. FIG. 31 is a schematic cutaway view of a purge volume reduction system 500*a* in a second closed position 502*b*.

The purge volume reduction system 500*a* comprises a reservoir tube 504 having a first lower end 506*a* and a second upper end 506*b* opposite the lower end 506*a*. A valve 508 is located at the lower end 506*a*, which is movable between a first open position 510*a* and a second closed position 510*b* with respect with the reservoir tube 504.

As seen in FIG. 30 and FIG. 31, a fluid inlet structure 28 is located at the lower region of the riser pipe within the well 15. A check valve 512 is located within the riser pipe 24, above the well screen/primary filter 28. The exemplary check valve 512 shown in FIG. 30 and FIG. 31 comprises a valve body 514 having a valve port defined therethrough, and a valve actuator 516, e.g. such as a ball 518 which is movable in relation to the port 516, between an open position 520*a* and a closed position 520*b*.

A sample return line 138 typically extends from the surface down the well within the riser pipe, to the vicinity above the check valve 512.

As seen in FIG. 30, the reservoir tube 504 is lowered 522 into the well 15 until the reservoir tube 504 reaches the top of the direct check valve 512. Water FL enters the reservoir tube 504 during this lowering procedure 522, since the valve 508 is in the first open position 510*a*.

As seen in FIG. 31, when the reservoir tube 504 and tube valve 508 contact the check valve 512, the tube valve 508 moves toward a closed position 510*b* (FIG. 31), in which the weight of the reservoir tube 504 typically pushes the valve closed 510*b*, trapping the water 525 inside the tube 504, so that the trapped water 525 is not purged when the direct pressure pneumatic pump system 526 is used and so that water 521 refilling the riser pipe 24 is not able to mix with the water 525 inside of the reservoir tube 504. In some system embodiments 500*a*, the top of the reservoir tube 504 reach almost to the top of the riser pipe 24. In alternate system embodiments 500*a*, the top of the reservoir tube 504 extends up to several feet above the top of the water 521.

The sample return line 138 may also be configured to run on the inside of the reservoir tube 504, exiting either just above the valve 508, or through the center of the valve mechanism 508.

Actuation for the reservoir tube valve 508 can comprise any of mechanical, electronic, hydraulic, and pneumatic remote actuation. Exemplary actuators for the reservoir tube valves 508 include, but are not limited to, drop weight actuators, cable pull actuators, electronically actuated valves, pneumatically actuated valves, hydraulically or pneumatically inflated packers, and valves which are closed by sealing the top of the reservoir tube 504 and pressurizing the inside of the reservoir tube 504.

The purge volume reduction system 500*a* shown in FIG. 30 and FIG. 31 includes a sealable reservoir tube 504 which reduces the purge volume of a well, i.e. by displacing a portion of the volume with the tube 504 and capturing, i.e. trapping, a portion 525 within the tube 504.

Figure 32:
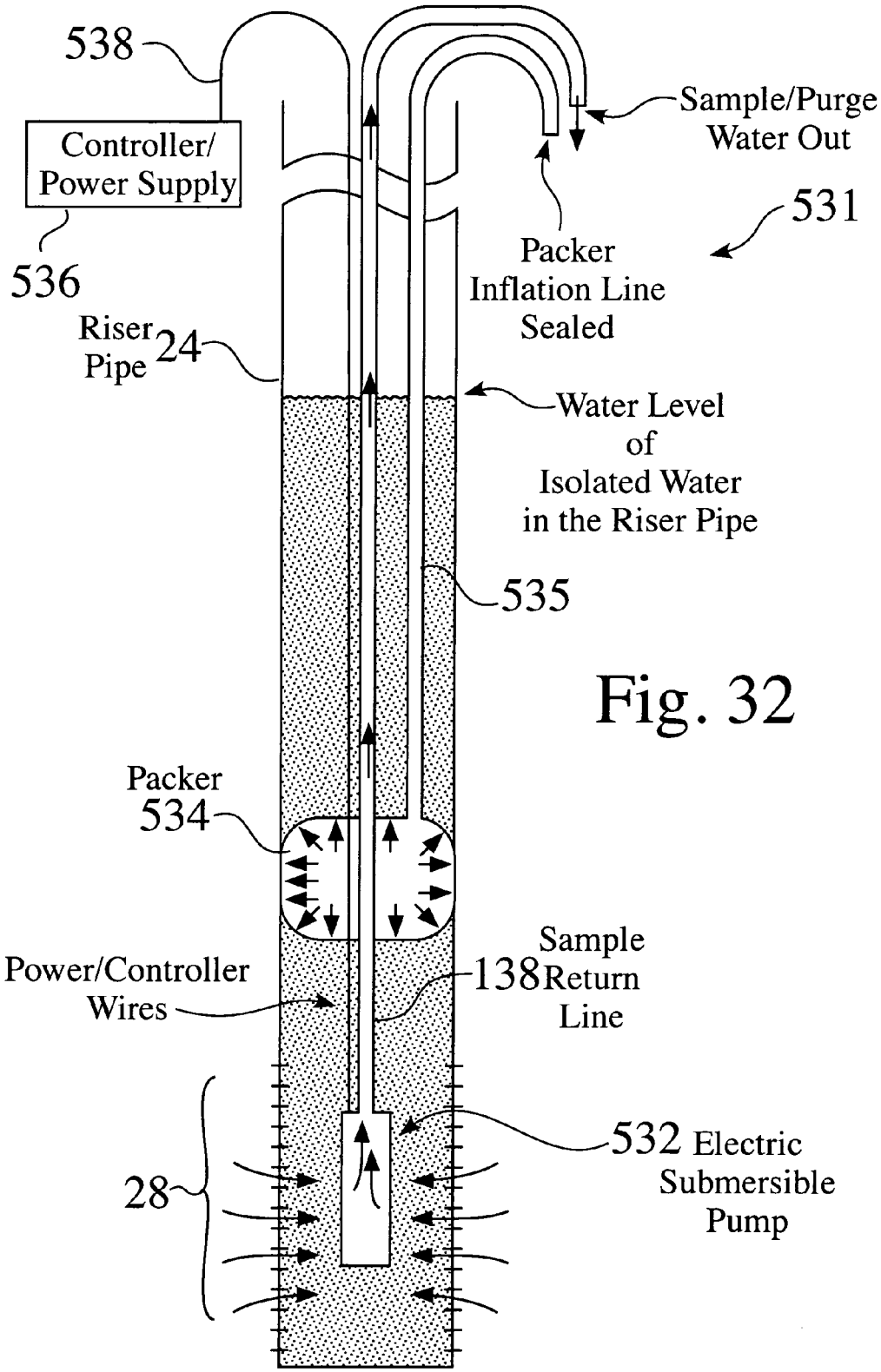
FIG. 32 is a schematic cutaway view of a pump located below an inflatable sealing device.

Inflatable packers have previously been used for placement of submersible pumps. For example, FIG. 32 is a schematic cutaway view of packer pump system 531 comprising a pump 532 located below an inflatable sealing device 534, such as a packer, which is placed above a screen 28 of a standard monitoring well.

The wires 538 and/or tube(s) which control standard well sampling pump(s) pass through the sealing device 534 to the pump 532, which is placed in the screened interval 28 of the well. In some embodiments of the packer pump system 531, the pump 532 comprises any of a pneumatic pump, a bladder pump, and an electric submersible pump.

While packer systems have previously provided structure for placement of submersible pumps and hardware, packers may alternately be implemented for purge volume reduction systems 500.

Figure 33:
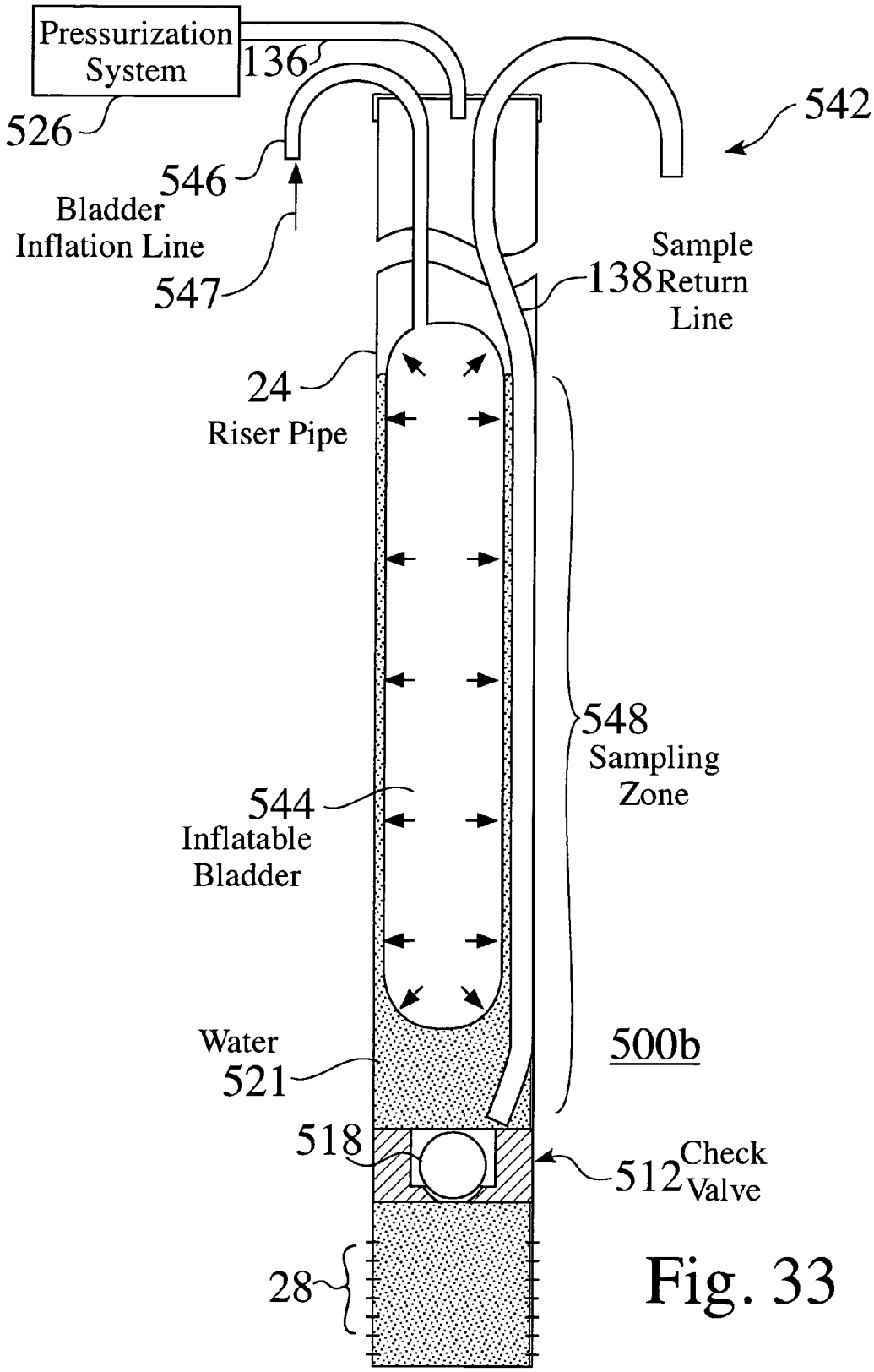
FIG. 33 is a schematic cutaway view of a device comprising an inflatable bladder.

FIG. 33 is a schematic cutaway view of an alternate purge volume reduction system 500*b*, which comprises an inflatable bladder 544. The purge volume reduction system 500*b* shown in FIG. 33 reduces the purge volume of a well 15, i.e. by displacing a portion of the volume with the bladder 544, by controllably inflating the bladder 544. A bladder inflation line 546 is typically attached to the bladder 544, whereby the bladder 544 can be controllably filled, such as by fluid or pressurized gas 547.

While the purge volume of a well 15 shown in FIG. 33 is reduced by an inflatable bladder 544, the purge volume may alternately be reduced by placing a removable object 544 within the purge volume, such as a solid object, at least one hollow tube other than the sample return line 138. As well, the purge volume may alternately be reduced by the sample line 138 itself, wherein the wall thickness of the sample line 138 is specifically chosen to reduce the purge volume.

Figure 34:
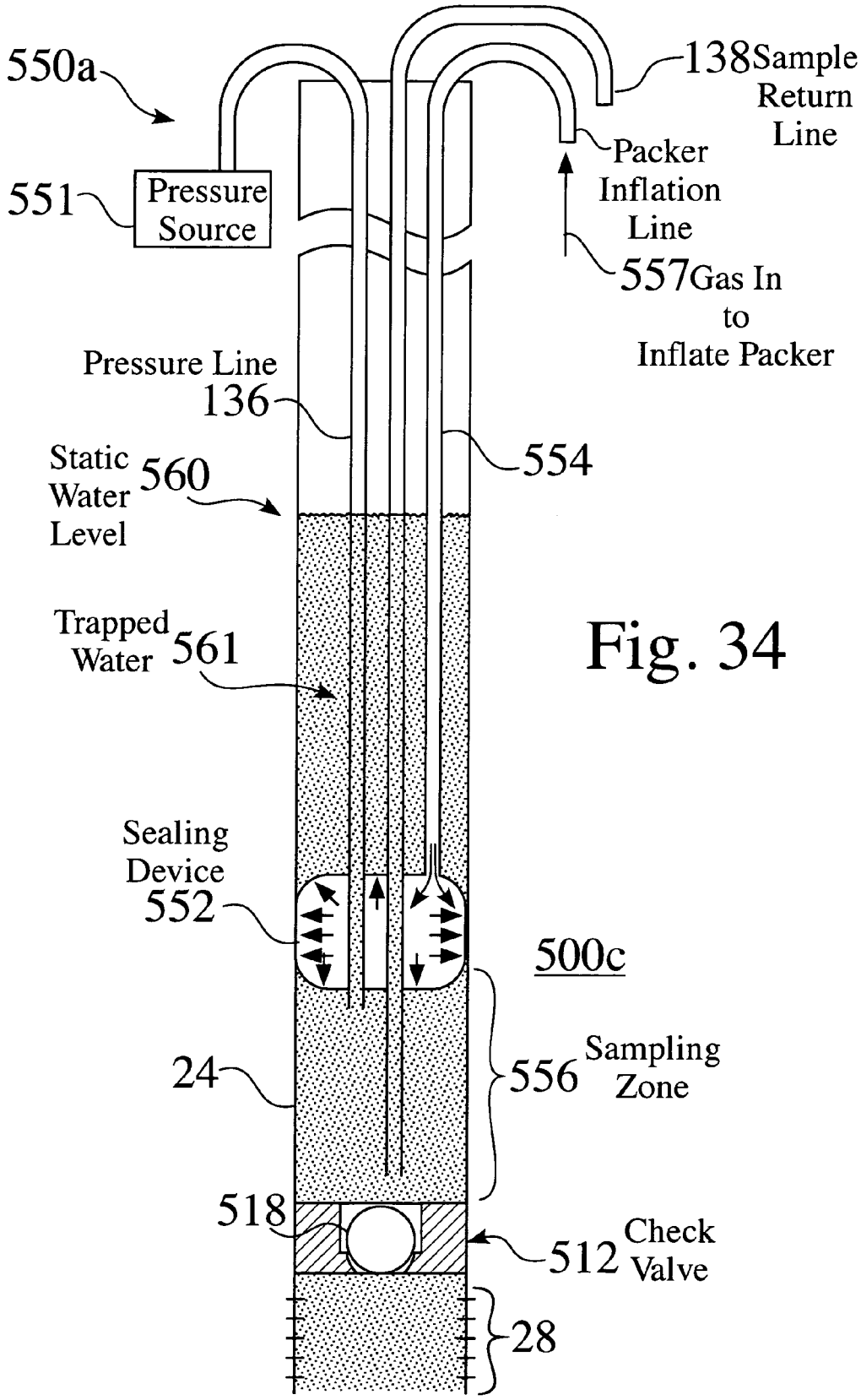
FIG. 34 shows a resting position for a structure comprising multiple sampling tubes extending below an inflatable sealing device.
Figure 35:
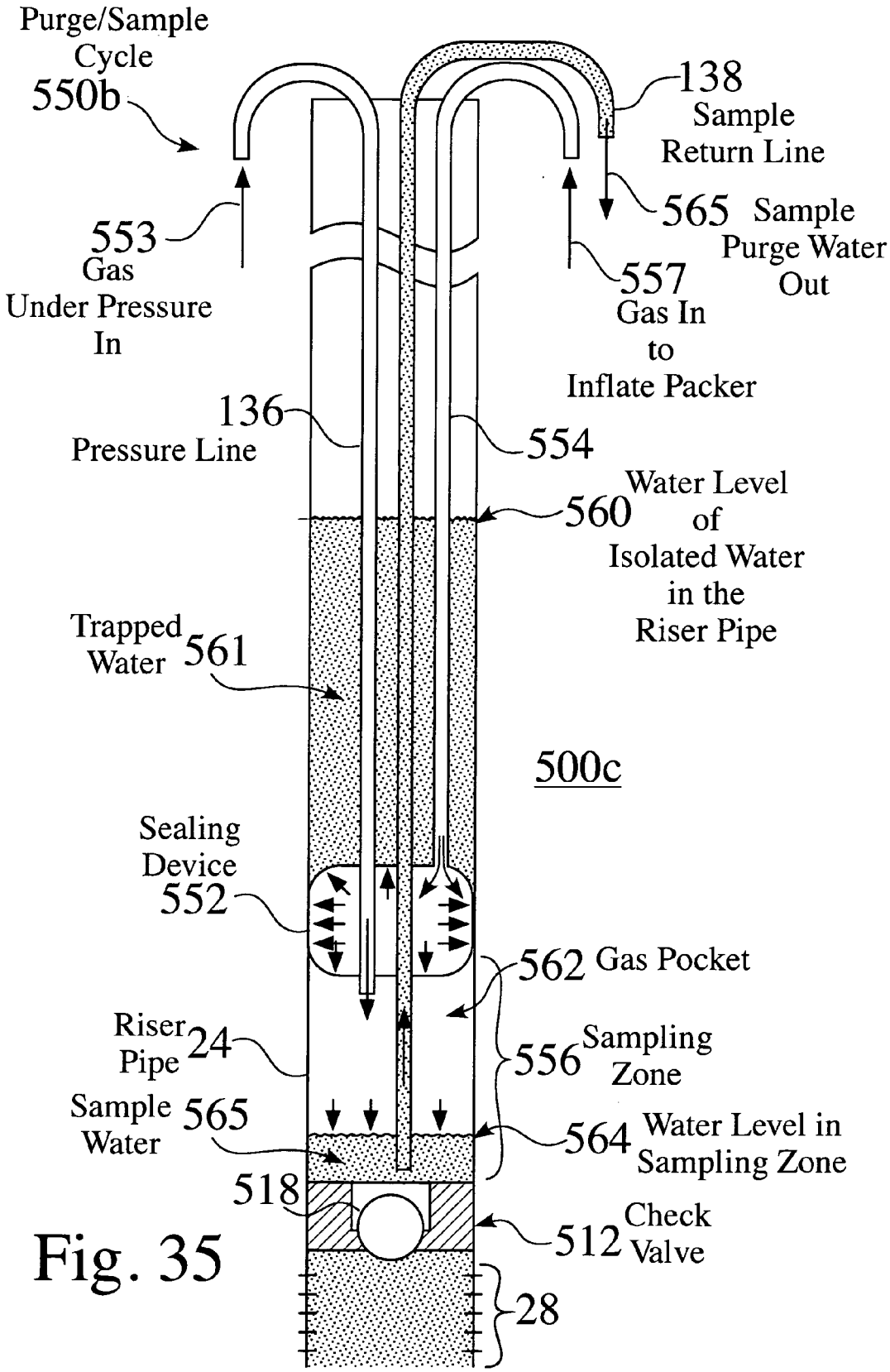
FIG. 35 shows a purge sample cycle for multiple sampling tubes extending below an inflatable sealing device.
Figure 36:
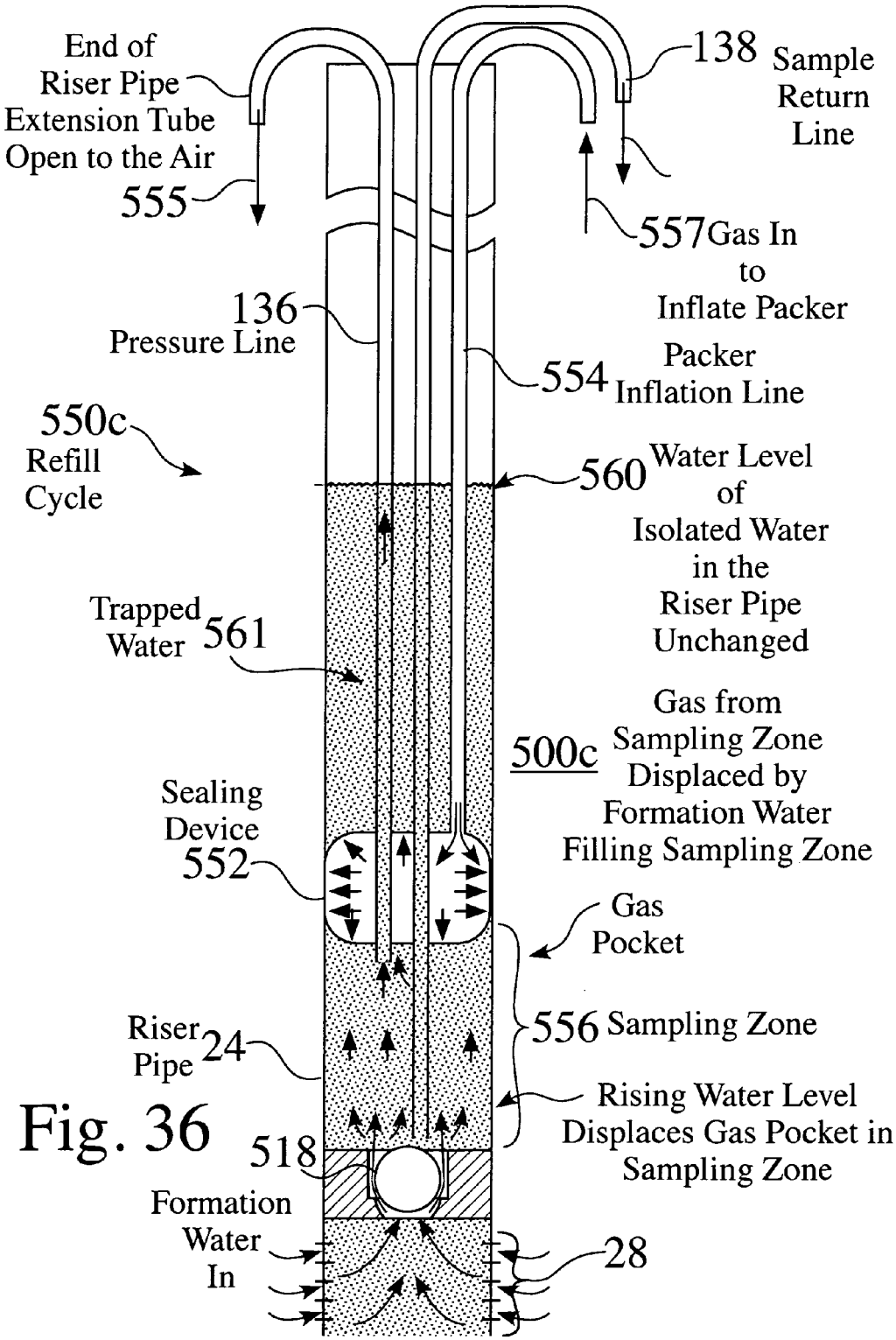
FIG. 36 shows a purge sample cycle for multiple sampling tubes extending below an inflatable sealing device.

FIG. 34 shows a resting position 550*a* for a purge volume reduction system 500*c*, which comprises a sampling tube 138 and a pressure line 136 which extend below an inflatable sealing device 552 to a sampling zone 556 located above a check valve 512 and well screen/primary filter 28 of a well 15. FIG. 35 shows a purge sample cycle 550*b* for a purge volume reduction system 500*c*. FIG. 36 shows a refill cycle 550*c* for a purge volume reduction system 500*c*.

In some system embodiments, the inflatable sealing device 552 comprises a packer 552. The pressure line 136 extends from below the sealing device 552 to the ground surface GS. The sample return line 138 extends from the ground surface GS, through the sealing device 552, and toward the top of well's primary valve 512. In some embodiments 500, the sample return line 138 is preferably placed so that the volume between the sealing device 552 and the well's primary valve 552 is the minimum quantity of water 521 required for a desired water sampling procedure. The pressure line 136, which extends to just below the sealing device 552, becomes an extension of the riser pipe 24 in the zone above the check valve 512.

As seen in FIG. 35, to sample the well 15, the pressure line 136 is pressurized 553 with enough pressure to lift the water 565 in the sampling zone 556 through the sample return line 138 and to the ground surface GS.

As seen in FIG. 36, when the pressure 553 is released, the sampling zone 556 refills with water 521 from the formation, passing through the well's screen/primary filter 28 and then through the check valve 512. The gas 555 in the sampling zone 556 is displaced up the riser pipe extension tube 558. The water 561 located above the sealing device 552 is kept in place, i.e. isolated, during this procedure 550, and is not purged from the system 500*c* during sampling 550*b*.

Figure 37:
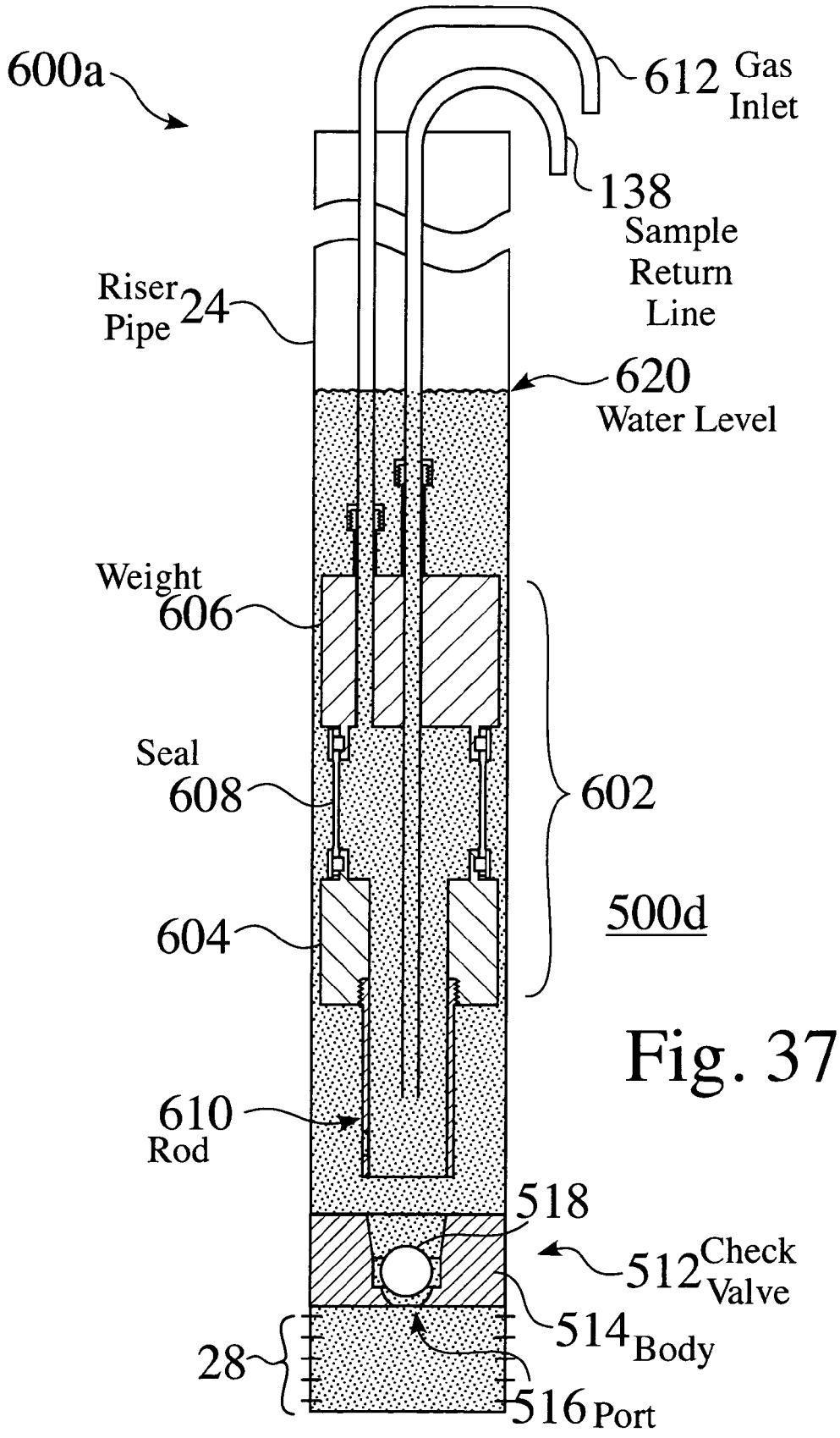
FIG. 37 is a schematic cutaway view of a weighted tube-style sealing device in a first unsealed position.
Figure 38:
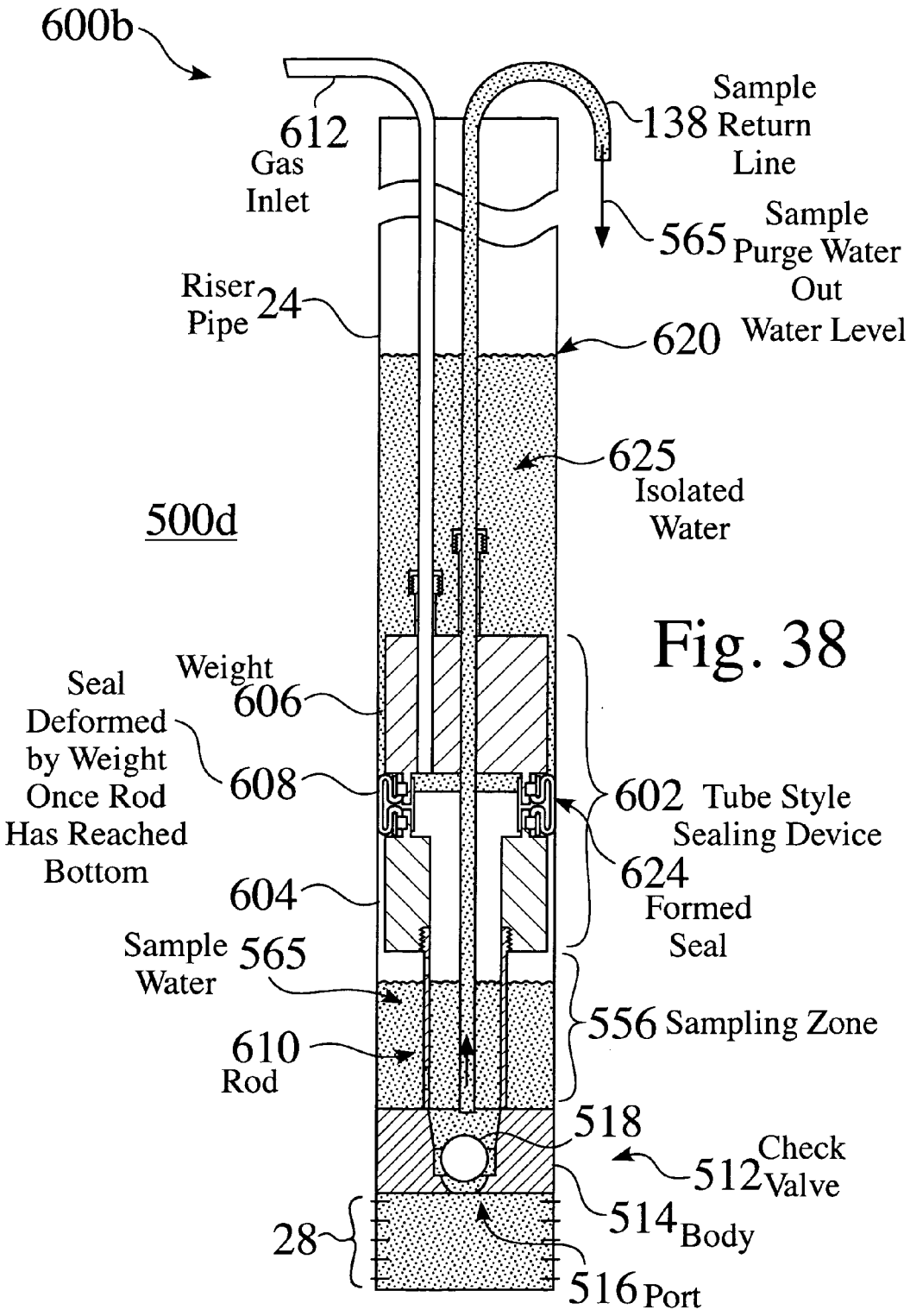
FIG. 38 is a schematic cutaway view of a weighted tube-style sealing device in a second sealed position.

FIG. 37 is a schematic cutaway view of a purge volume reduction system 500*d* comprising a weighted sealing device 602 in a first unsealed position 600*a*. FIG. 38 is a schematic cutaway view of a purge volume reduction system 500*d* comprising a weighted sealing device 602 in a second sealed position 600*b*. The sealing device 602 comprises a hollow lower body and hollow rod 610, as well as an upper body 606 that is longitudinally movable in relation to the lower body 604. A seal structure 608 extends between the upper body 606 and the lower body 604, which in some embodiments 602 comprises a flexible tube, such as but not limited to rubber.

The hollow rod extends down from the lower body 604, below the seal 608, to rest on the top of the purge system's valve housing 514. When the seal 608 and sample return line 138 are lowered into the well, the tube seal 608 is under tension and allows water 521 to flow around the periphery of the seal 608. When the rod 610 reaches the top of the purge system's valve housing 514, as shown in FIG. 38, the weight of the upper body 606 presses down on the tube 608, deforming the tube 608 outward to form the seal 624 against the riser pipe 24 of the well.

As seen in FIG. 38, when purge volume reduction system 500*d* is in the second sealed position 600*b*, the system 500*d* is readily used to purge or sample a water FL within a sampling zone 556, which does not include isolated water 625 located above the formed seal 624. For example, with the check valve closed, the gas inlet 612 is readily pressurized, whereby the water within the sampling zone 556 enters the sample return line and travels toward the surface GS.

Figure 39:
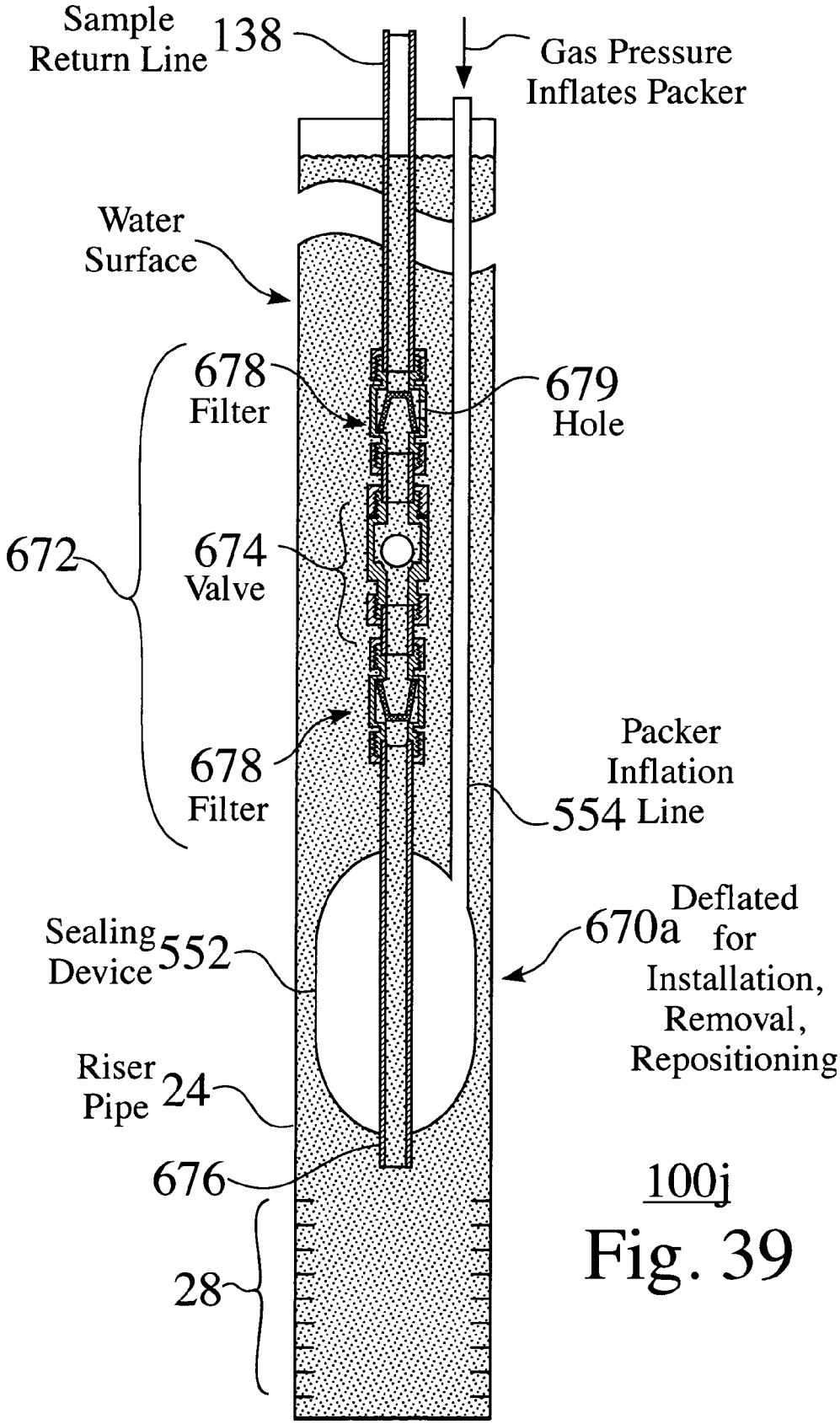
FIG. 39 is a schematic cutaway view of a direct pressure sample/purge system comprising a sampling structure which extends below an inflatable sealing device, in which the sealing device is in a deflated position.
Figure 40:
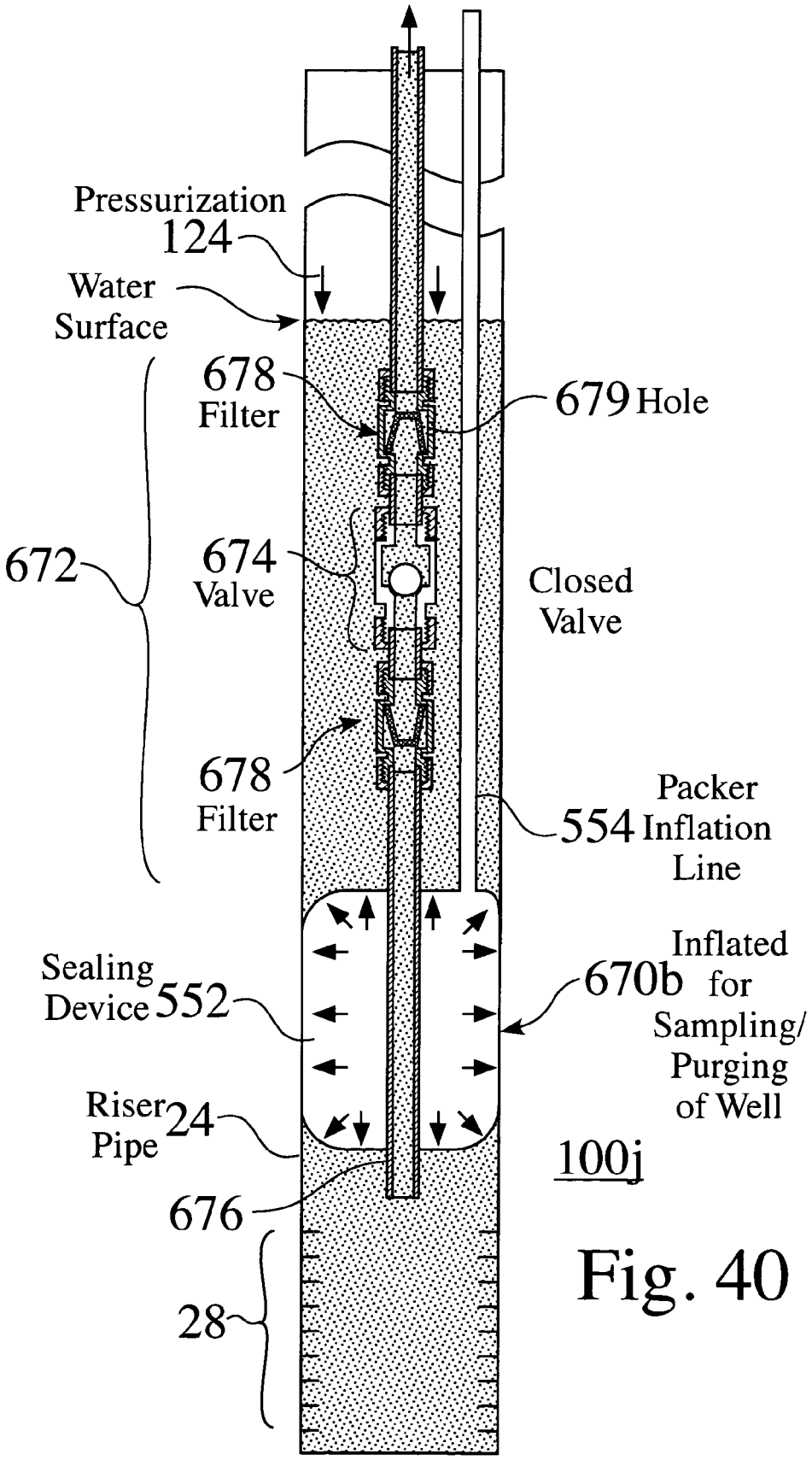
FIG. 40 is a schematic cutaway view of a direct pressure sample/purge system comprising a sampling structure, in which the sealing device is in an inflated sealed position.

FIG. 39 is a schematic cutaway view of a direct pressure sample/purge system 100*j* comprising a sampling structure 672 which extends below an inflatable sealing device 552, such as a packer, which is placed above a screen 28 of a standard monitoring well 15, in which the sealing device 552 is in a deflated position 670*a*. FIG. 40 is a schematic cutaway view of a direct pressure sample/purge system 100*j* comprising a sampling structure 672, in which the sealing device 552 is in an inflated, i.e. sealed position 670*b*.

For sampling systems 500 which comprise inflatable seals 552, one-way check valve 674, typically a ball valve, placed above the screened interval of a narrow diameter well or piezometer so that the blank casing of the well becomes the outer housing of the pneumatic pump. The valve may be any type of one-way check valve, including, but not limited to, rubber "duck bill" or reed valves, poppet valves, flapper valves, and needle valves. In some embodiments, a ball valve 674 is preferred, to minimize the risk of jamming.

In reference to FIG. 39 and FIG. 40, a filter 678 may also preferably placed above and below the valve 674 to protect the valve from stray sand particles. A rigid tube, that is part of, or is surrounded by, a packer or similar inflatable seal 552 extends below the valve 674. The end of the tube 676 is open. In alternate embodiments 500*f*, he valve 674 may also be at or below the packer 552. A flexible tube, called the sample return line and typically made of Teflon, nylon, or plastic, is attached to the upper end of the valve by a short tube, typically metal. There is a hole in the side of the tube that opens into the inside of the well's casing, above the packer. The upper end of the tube extends above the ground surface. A second flexible tube, the packer inflation line, which is typically made of nylon, Teflon or similar plastic, is attached to the top of the packer or similar inflatable seal and also extends above the ground surface. This line 554 is used to expand the packer to form a seal against the inside wall of the well's riser pipe. Typically the expansion is accomplished by pressurizing the line with compressed gas, but can be done by releasing pressure, depending on the design of the packer.

During pressurization 124 (FIG. 40) for purging or sampling, the applied pressure 124 acts through hole 679 to close the valve 674. Water FL from the sampling zone, i.e. from the initial water surface down to the hole 679, is sampled or purged through the sample return line 138.

System Advantages. Use of the purge volume reduction systems 500 reduce the volume of water FL produced during the purge process. Excess purge water FL from purge/sampling procedures can be expensive to properly dispose of. Reducing the volume of water FL would also reduce the field technician time necessary to purge and sample a well. Use of these systems 500 also reduces the quantity of gas required to purge and sample wells using pneumatically driven pumping methods.

The purge reduction systems 500 are also very important for reducing the volume of compressed gas required to purge and sample a well. While such savings may not be a significant advantage for a typical shallow well, which can be easily sampled using an air compressor or a minor quantity of compressed gas, the reduction of the volume of compressed gas becomes a major cost saver when sampling deep wells, and especially so in remote areas.

For example, in the case of a single 1 inch internal diameter 500 foot well, each purge cycle would require about 45 cubic feet of gas for a total of about 135 cubic feet of gas for 2 purge cycles and a sampling cycle. Since the 250 psi required for a well this deep exceeds the capacity of typical portable oilless air compressors, the transport of a large gas cylinder would be required in order to sample one or two wells. If a given field site is very remote, and/or has numerous wells or has wells which are not accessible by truck, the logistics become time consuming and expensive. A significant reduction in gas usage can provide a significant cost and time savings.

The disclosed purge volume reduction systems 500 are readily used within a wide variety of direct pneumatic pressure pumping systems 100, and can also be implemented for a wide variety of other pumping methods.

Although the direct pressurization and purge reduction systems and methods of use are described herein in connection with small diameter water wells, the apparatus and techniques can be implemented for other wells and piezometers, or any combination thereof, as desired.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

What is claimed is:

1. An apparatus for sampling fluid within a well having a riser pipe having an internal wall, the riser pipe extending from a ground surface to a fluid inlet structure comprising any of a filter and a screen, the apparatus comprising:

a removable valve structure;

means for extending the removable valve structure down the riser pipe from the ground surface toward the fluid inlet structure;

a sample return line located in the riser pipe above the removable valve structure;

means for controllably establishing a seal between the removable valve structure and the riser pipe;

means for applying direct pneumatic pressure down the riser pipe structure;

means for sampling at least a portion of the fluid within the well;

means for controllably releasing the seal between the removable valve structure and the riser pipe; and means for retrieving the sampling means and at least a portion of the removable valve structure up the riser pipe toward the ground surface, while retaining at least a portion of the removable valve structure within the well.

2. The apparatus of claim 1, wherein the means for applying pressure comprises any of a compressor and a compressed gas source.

3. The apparatus of claim 1, wherein the well further comprises a primary valve located in the riser pipe above the fluid inlet structure.

4. The apparatus of claim 3, wherein the means for applying pressure comprises a direct pneumatic pressure pump having a primary valve which is removable through the riser pipe without removing any of the riser pipe and the fluid inlet structure.

5. The apparatus of claim 1, wherein the well comprises any of a well having a diameter of less than or equal to two inches and a piezometer.

6. The apparatus of claim 1, wherein the sampling comprises any of purging and sampling.

7. The apparatus of claim 1, wherein the retrieved portion of the removable valve structure comprises a primary valve, and wherein the retained portion comprises the riser pipe and the fluid inlet structure.

8. The apparatus of claim 1, wherein the apparatus is retrofittable to the well, and wherein the removable valve structure is adapted for any of purging and sampling.

9. The apparatus of claim 1, wherein the sampling means comprises a sample return line which extends from the removable valve structure to the ground surface.

10. The apparatus of claim 1, wherein the sampling means comprises a plurality of sample return lines having an inlet end and an exit end which extend from the removable valve structure to the ground surface.

11. The apparatus of claim 10, further comprising:

a control valve on each of the plurality of sample return lines.

12. The apparatus of claim 11, wherein the control valves are controllably operable between an open position and a closed position.

13. The apparatus of claim 11, wherein the control valves are controllably operable at any point between an open position and a closed position.

14. The apparatus of claim 11, further comprising:

a check valve on each of the plurality of sample return lines between the inlet end and the control valve.

15. The apparatus of claim 10, further comprising:

a check valve on each of the plurality of sample return lines, which allow flow from the removable valve structure toward the ground surface, and substantially prevent flow from the sample return lines toward the removable valve structure.

16. The apparatus of claim 1, further comprising:

a sealable top cap located at the top of the riser pipe;

whereby the sealed valve, the riser pipe, and the top cap form a pressure vessel.

17. The apparatus of claim 16, further comprising:

a valve seat;

wherein the removable valve is sealably seated in relation to the valve seat.

18. The apparatus of claim 17, wherein the valve seat is removable.

19. The apparatus of claim 17, wherein the valve seat is located at the bottom of the riser pipe.

20. The apparatus of claim 17, wherein the valve seat is located above the bottom of the riser pipe.

21. The apparatus of claim 16, wherein the removable valve is sealable against the internal wall of the riser pipe.

22. The apparatus of claim 1, further comprising:

means for attaching a tool to at least a portion of the removable valve.

23. The apparatus of claim 22, wherein the tool comprises any of an installation tool and a removal tool.

24. The apparatus of claim 1, further comprising:

means for removing the removable valve through the riser pipe structure, without removing any of the riser pipe and the fluid inlet structure.

25. The apparatus of claim 1, further comprising:

a sample return line attached to the removable valve.

26. A process for sampling fluid within a well having a riser pipe having an internal wall, the riser pipe extending from a ground surface to a fluid inlet structure comprising any of a filter and a screen, the process comprising the steps of:

providing a removable valve structure;

extending the removable valve structure down the riser pipe from the ground surface toward the fluid inlet structure;

controllably establishing a seal between the removable valve structure and the riser pipe;

applying direct pneumatic pressure down the riser pipe structure;

collecting at least a portion of the fluid within the well;

controllably releasing the seal between the removable valve structure and the riser pipe; and retrieving a portion of the removable valve structure up the riser pipe toward the ground surface, while retaining at least a portion of the removable valve structure within the well.

27. The process of claim 26, wherein the pressure is applied by any of a compressor and a compressed gas source.

28. The process of claim 26, wherein the well further comprises a primary valve located in the riser pipe above the fluid inlet structure.

29. The process of claim 28, wherein the direct pneumatic pressure pump has a primary valve which is removable through the riser pipe without removing any of the riser pipe and the fluid inlet structure.

30. The process of claim 26, wherein the well comprises any of a well having a diameter of less than or equal to two inches and a piezometer.

31. The process of claim 26, wherein the collecting comprises any of purging and sampling.

32. The process of claim 26, wherein the retrieved portion of the removable valve structure comprises a primary valve, and wherein the retained portion comprises the riser pipe and the fluid inlet structure.

33. The process of claim 26, wherein the collecting means comprises a sample return line which extends from the removable valve structure to the ground surface.

34. The process of claim 26, further comprising the step of:

providing a plurality of sample return lines having an inlet end and an exit end which extend from the removable valve structure to the ground surface;

wherein the sampling step comprises sampling at least a portion of the fluid within the well through the plurality of sample return lines.

35. The process of claim 34, further comprising the step of:

providing a control valve on each of the plurality of sample return lines.

36. The process of claim 35, wherein the control valves are controllably operable between an open position and a closed position.

37. The process of claim 35, wherein the control valves are controllably operable at any point between an open position and a closed position.

38. The process of claim 34, further comprising the step of:

providing a check valve on each of the plurality of sample return lines between the inlet end and the control valve.

39. The process of claim 34, further comprising the step of:

providing a check valve on each of the plurality of sample return lines, which allows flow from the removable valve structure toward the ground surface, and substantially prevents flow from the sample return lines toward the removable valve structure.

40. The process of claim 26, wherein the removable valve structure is retrofittable to the well, and is adapted for any of purging and sampling.

41. The process of claim 26, further comprising the step of:

sealing the top of the riser pipe with a top cap;

whereby the sealed valve, the riser pipe, and the top cap form a pressure vessel.

42. The process of claim 26, wherein the well further comprises a valve seat, and further comprising the step of:

sealably seating the removable valve in relation to the valve seat.

43. The process of claim 42, wherein the valve seat is removable.

44. The process of claim 42, wherein the valve seat is located at the bottom of the riser pipe.

45. The process of claim 42, wherein the valve seat is located above the bottom of the riser pipe.

46. The process of claim 26, further comprising the step of:

sealing the removable valve against the internal wall of the riser pipe.

47. The process of claim 26, further comprising:

attaching a tool to at least a portion of the removable valve.

48. The process of claim 47, wherein the tool comprises any of an installation tool and a removal tool.

49. The process of claim 26, further comprising:

removing the removable valve through the riser pipe structure, without removing any of the riser pipe and the fluid inlet structure.

50. The process of claim 26, further comprising the step of:

attaching a sample return line to the removable valve.

51. An apparatus for collecting fluid within a well extending from a ground surface, comprising:

a chamber having a hollow region defined therein extending from a bottom end to a top end;

a chamber check valve located on the chamber which allows fluid flow into the hollow region;

a plurality of hollow return lines extending from within the hollow region of the chamber toward the ground surface; and means for applying pneumatic pressure to the hollow region;

wherein the plurality of hollow return lines are chosen to improve the flow rate of fluid from the apparatus toward the ground surface.

52. The apparatus of claim 51, wherein the means for applying pneumatic pressure comprises an inflatable bladder located within the hollow region sealably attached between the chamber check valve and the plurality of hollow return lines; and a check valve located on each of the return lines, which allows flow from the interior region of the bladder toward the ground surface, and substantially prevents flow from the hollow return lines toward the interior region of the bladder.

53. The apparatus of claim 52, further comprising:

a hollow conduit extending from the plurality of hollow return lines toward the chamber check valve.

54. The apparatus of claim 51, wherein the means for applying pneumatic pressure comprises a pressure line extending from the ground surface to the hollow region.

55. The apparatus of claim 54, further comprising:

a check valve located on the pressure line which prevents liquid to flow from the hollow region of the chamber toward the ground surface.

56. The apparatus of claim 55, wherein the check valve located on the pressure line allows gas to flow from the hollow region of the chamber toward the ground surface.

57. The apparatus of claim 51, further comprising:

a valve on each of the hollow return lines.

58. The apparatus of claim 57, wherein the valves are controllably operable between an open position and a closed position.

59. The apparatus of claim 57, wherein the valves are controllably operable at any point between an open position and a closed position.

60. The apparatus of claim 51, further comprising:

a check valve on each of the hollow return lines, which prevents fluid from flowing toward the hollow region.

61. The apparatus of claim 51, wherein the chamber check valve comprises any of a ball and seat valve, a duck bill valve, a reed valve, a poppet valve, a flapper valve, and a needle valve.

62. The apparatus of claim 51, wherein the chamber check valve is remotely actuatable.

63. The apparatus of claim 62, wherein the remote actuation of the chamber check valve comprises any of pneumatic actuation, electronic actuation, and mechanical actuation.

64. A method for collecting fluid within a well extending from a ground surface, comprising:

providing a chamber having a hollow region defined therein extending from a bottom end to a top end;

providing a chamber check valve located on the chamber which allows fluid to flow into the hollow region;

connecting a plurality of hollow return lines extending from within the hollow region of the chamber toward the ground surface; and applying pneumatic pressure to the hollow region, which allows fluid within the hollow region to flow through the hollow return lines toward the ground surface;

wherein the plurality of hollow return lines are chosen to improve the flow rate of fluid from the chamber to the ground surface.

65. An apparatus for collecting fluid within a well extending from a ground surface, comprising:

a chamber having a hollow region defined therein extending from a bottom end to a top end;

a chamber check valve located on the chamber which allows fluid flow into the hollow region;

a plurality of hollow return lines extending from within the hollow region of the chamber toward the ground surface;

means for applying pneumatic pressure to the hollow region, comprising an inflatable bladder located within the hollow region sealably attached between the chamber check valve and the plurality of hollow return lines; and a check valve located on each of the return lines, which allows flow from the interior region of the bladder toward the ground surface, and substantially prevents flow from the hollow return lines toward the interior region of the bladder.

66. The apparatus of claim 65, further comprising:

a hollow conduit extending from the plurality of hollow return lines toward the chamber check valve.

67. An apparatus for collecting fluid within a well extending from a ground surface, comprising:

a chamber having a hollow region defined therein extending from a bottom end to a top end;

a chamber check valve located on the chamber which allows fluid flow into the hollow region;

a plurality of hollow return lines extending from within the hollow region of the chamber toward the ground surface; and means for applying pneumatic pressure to the hollow region, comprising a pressure line extending from the ground surface to the hollow region; and a check valve located on the pressure line which prevents liquid to flow from the hollow region of the chamber toward the ground surface, wherein the check valve located on the pressure line allows gas to flow from the hollow region of the chamber toward the ground surface.

68. An apparatus for collecting fluid within a well extending from a ground surface, comprising:

a chamber having a hollow region defined therein extending from a bottom end to a top end;

a chamber check valve located on the chamber which allows fluid flow into the hollow region;

a plurality of hollow return lines extending from within the hollow region of the chamber toward the ground surface;

means for applying pneumatic pressure to the hollow region; and a valve on each of the hollow return lines.

69. The apparatus of claim 68, wherein the valves are controllably operable between an open position and a closed position.

70. The apparatus of claim 68, wherein the valves are controllably operable at any point between an open position and a closed position.

71. An apparatus for collecting fluid within a well extending from a ground surface, comprising:

a chamber having a hollow region defined therein extending from a bottom end to a top end;

a chamber check valve located on the chamber which allows fluid flow into the hollow region;

a plurality of hollow return lines extending from within the hollow region of the chamber toward the ground surface;

means for applying pneumatic pressure to the hollow region; and a check valve on each of the hollow return lines, which prevents fluid from flowing toward the hollow region.

72. An apparatus for reducing the purge volume of a well, comprising:

means for dividing the purge volume of the well into a first region and a second region, wherein the first region is sealably isolated from the second region, wherein the dividing means comprises a hollow tube having a first lower end and a second upper end opposite the first lower end, and an actuatable valve located at the first lower end of the hollow tube, wherein the valve is closable when the hollow tube is located within the well to isolate a fluid located within the hollow tube;

a sample return line connected to the second region; and means for applying pneumatic pressure to the second region to promote sampling of fluid from the second region.

73. The apparatus of claim 72, wherein the hollow tube is sealable and pressurizable.

74. The apparatus of claim 72, wherein the actuator for the valve comprises any of a mechanical actuator, an electronic actuator, a hydraulic actuator, and a pneumatic actuator.

75. An apparatus for reducing a purge volume of a well, comprising:

a sample return line extending into the well;

means for displacing at least a portion of the purge volume of the well, the displacing means comprising a removable object placed within the purge volume, the removable object comprising any of a solid object and at least one hollow tube other than the sample return line; and means for applying pressure to the well to promote sampling of fluid from the sample return line.

76. An apparatus for reducing a purge volume of a well, comprising:

a sample return line extending into the well;

means for displacing at least a portion of the purge volume of the well, wherein the displacing means comprises a removable object placed within the purge volume, wherein the removable object comprises the sample return line, and wherein the wall thickness of the sample line is specifically chosen to reduce the purge volume; and means for applying pressure to the well to promote sampling of fluid from the sample return line.

77. An apparatus for reducing a purge volume of a well, comprising:

a sample return line extending into the well;

means for displacing at least a portion of the purge volume of the well, the displacing means comprising an object other than the sample return line, wherein the displacing means comprises a removable object placed within the purge volume, wherein the removable object comprises any of a solid object and at least one hollow tube other than the sample return line; and means for applying pressure to the well to promote sampling of fluid from the sample return line.

* * * * *

UNITED STATES PATENT AND TRADEMARK OFFICE
Certificate

Patent No. 7,111,682 B2 Patented: September 26, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Mark Kevin Blaisdell, Concord, CA (US); and Noah R. Heller, Corte Madera, CA (US).

Signed and Sealed this Eleventh Day of August 2009.

DAVID J. BAGNELL
*Supervisory Patent Examiner*
Art Unit 3672